US006087055A

United States Patent [19]

Niimi

[11] Patent Number: 6,087,055

[45] Date of Patent: Jul. 11, 2000

[54] ELECTROPHOTOGRAPHIC PHOTOCONDUCTOR

[75] Inventor: Tatsuya Niimi, Shizuoka, Japan

[73] Assignee: Ricoh Company, Ltd., Tokyo, Japan

[21] Appl. No.: 09/034,321

[22] Filed: Mar. 4, 1998

[30] Foreign Application Priority Data

Mar. 4, 1997 [JP] Japan ..... 9-063956
Mar. 3, 1998 [JP] Japan ..... 10-066045

[51] Int. Cl.[7] ..... G03G 5/06

[52] U.S. Cl. ..... 430/58.7; 430/59.2; 430/73

[58] Field of Search ..... 430/58.7, 59.2, 430/73

[56] References Cited

U.S. PATENT DOCUMENTS 4,314,015 2/1982 Hashimoto et al. ..... 430/71
5,804,343 9/1998 Umeda et al. ..... 430/96

*Primary Examiner*—John Goodrow
*Attorney, Agent, or Firm*—Oblon, Spivak, McClelland, Maier & Neustadt, P.C.

[57] ABSTRACT

An electrophotographic photoconductor has an electroconductive support, and a photoconductive layer formed thereon containing an azo pigment of formula (1):

(1)

wherein $R^{201}$ and $R^{202}$ are each a hydrogen atom, a halogen atom, an alkyl group, an alkoxyl group or cyano group; and $Cp^1$ and $Cp^2$ are each independently a coupler radical represented by formula (2):

(2)

in which $R^{203}$ is a hydrogen atom, an alkyl group or an aryl group; $R^{204}$ to $R^{208}$ are each a hydrogen atom, nitro group, cyano group, a halogen atom, an alkyl group, trifluoromethyl group, an alkoxyl group, a dialkylamino group, or hydroxyl group; and Z is an atomic group which constitutes a substituted or unsubstituted aromatic hydrocarbon ring, or a substituted or unsubstituted aromatic heterocyclic ring, the azo pigment showing a diffraction peak at a Bragg angle of 26.5±0.8° in the X-ray diffraction spectrum with respect to Cu—Kα ray, and a half-width of 2° or more at the Bragg angle of 26.5±0.8°.

14 Claims, 2 Drawing Sheets

ELECTROPHOTOGRAPHIC PHOTOCONDUCTOR

BACKGROUND OF THE INVENTION

1. Field of the Invention

The present invention relates to an electrophotographic photoconductor for use in a copying machine, laser printer and laser facsimile apparatus.

2. Discussion of Background

The Carlson process and other processes obtained by modifying the Carlson process are conventionally known as the electrophotographic methods, and widely utilized in the copying machine and printer. In a photoconductor for use with the electrophotographic method, an organic photoconductive material is now widely used because such an organic photoconductor can be manufactured at low cost by mass production, and causes no environmental pollution.

Many kinds of organic photoconductors are conventionally proposed, for example, a photoconductor employing a photoconductive resin such as polyvinylcarbazole (PVK); a photoconductor comprising a charge transport complex of polyvinylcarbazole (PVK) and 2,4,7-trinitrofluorenone (TNF); a photoconductor of a pigment dispersed type in which a phthalocyanine pigment is dispersed in a binder resin; and a function-separating photoconductor comprising a charge generation material and a charge transport material. In particular, the function-separating photoconductor has now attracted considerable attention.

When the function-separating photoconductor is charged to a predetermined polarity and exposed to light, the light passes through a transparent charge transport layer, and is absorbed by a charge generation material in a charge generation layer. The charge generation material generates charge carriers by the absorption of light. The charge carriers generated in the charge generation layer are injected into the charge transport layer, and move in the charge transport layer depending on the electric field generated by the charging process. Thus, latent electrostatic images are formed on the surface of the photoconductor by neutralizing the charge thereon. As is known, it is effective that the function-separating electrophotographic photoconductor employ in combination a charge transport material having an absorption intensity mainly in the ultraviolet region, and a charge generation material having an absorption intensity mainly in a range from the visible region extending to the near infrared region.

In line with the trend toward high-speed copying process and small-size copying machine, there are increasing demands for high sensitivity, quick response performance and high durability of the electrophotographic photoconductor for use with the electrophotographic copying process.

In terms of durability of the photoconductor in the repeated electrophotographic process, the constituting materials and the structure of the photoconductor have been studied not only to prevent the electrical deterioration, that is, the increase of residual potential and the decrease of charging potential, but also to minimize the scraping of the surface top layer of the photoconductor and increase the mechanical strength of the photoconductor.

With respect to high sensitivity and quick response performance of the photoconductor, the generating mechanism of photocarriers in the photoconductor has been analyzed and intensively studied. The generating mechanism of the photocarriers, which varies depending upon the kind of charge generation material, is reported in many references, for example, in P. M. Borsenberger and D. S. Weiss: Organic Photoreceptors for Imaging Systems, Marcel Dekker (1993) Chap. 5,6.

Such mechanism can be roughly divided into two groups. One is the mechanism for a charge generation material to intrinsically generate the photocarriers by itself. This mechanism will be hereinafter referred to as intrinsic mechanism. A phthalocyanine compound is one representative example of the charge generation materials showing the intrinsic mechanism. The other mechanism of generating the photocarrier is extrinsic (which mechanism will be hereinafter referred to as extrinsic mechanism), and this mechanism can be typically seen in an azo pigment. Namely, such an azo pigment cannot generate the photocarriers without the application of any external factor thereto.

The charge generation material generates an exciton (the charge generation material in an excited condition) when absorbs the light. In the case of the intrinsic mechanism, the exciton (excited charge generation material) forms a geminate pair by the mutual reaction between the exciton and the charge generation material not excited. In contrast to this, the geminate pair is formed by the mutual reaction between the exciton and the charge transport material in the extrinsic mechanism. In any case, the geminate pair thus formed is then dissociated into free carriers.

The exciton of an inorganic charge generation material is directly dissociated into free carriers. Unlike the inorganic charge generation material, the organic charge generation material generates the free carriers through at least two steps of the generation of a geminate pair and the dissociation of the geminate pair into free carriers. In order to improve the sensitivity of the organic photoconductor, therefore, the quantum yield of the free carriers may be increased by increasing the quantum efficiency at each of the above-mentioned steps.

To be more specific, the geminate pair is generated by electron transfer reaction between two molecules which are considered to be a minimum unit. The quantum efficiency in the generation of the geminate pair by the electron transfer reaction is determined by the factors such as the mixing degree of two molecules and the energy level thereof. On the other hand, it is reported that the dissociation of the geminate pair into free carriers depends on the applied electric field, but the detailed mechanism of dissociation of the geminate pair into free carriers has not yet been clarified. Namely, any technique that is capable of promoting the process of dissociation of the geminate pair into free carriers has not been found.

In view of the above-mentioned present conditions, to improve the sensitivity of the photoconductor, there remains the subject how to increase the reaction efficiency in the dissociation of the geminate pair into the free carriers.

To obtain the electrophotographic photoconductor with high photosensitivity, the particular charge generation materials are proposed, as disclosed in Japanese Laid-Open Patent Application 5-32905 or the like. Although those conventional charge generation materials are remarkably effective and the photoconductors using such charge generation materials show high sensitivity, deterioration of such performance cannot be avoided in practice after repeated operations for an extended period of time.

On the other hand, many trials have been made to improve the mechanical durability of the photoconductor. Various low-molecular weight compounds have been developed to obtain the charge transport materials. The film-forming properties of such a low-molecular weight compound are very poor, so that the low-molecular weight charge transport material is dispersed and mixed with an inert polymer to prepare a charge transport layer. The charge transport layer thus prepared using the low-molecular weight charge transport material and the inert polymer is generally so soft that the charge transport layer is easily scraped off during the repeated electrophotographic operations by the Carlson process.

In addition, when the charge transport layer comprises the above-mentioned low-molecular weight charge transport material, the charge mobility has its limit therein. This is because the low-molecular weight charge transport material is contained in the charge transport layer in an amount of 50 wt. % at most. The Carlson process cannot be accordingly carried out at high speed, and the size of electrophotographic apparatus cannot be decreased. The charge mobility can be improved by increasing the amount of such a low-molecular weight charge transport material. In such a case, however, the film-forming properties of the charge transport layer deteriorate.

To solve the above-mentioned problems of the low-molecular weight charge transport material, considerable attention has been paid to a high-molecular weight charge transport material. A variety of high-molecular weight charge transport materials are proposed, for example, as disclosed in Japanese Laid-Open Patent Applications Nos. 51-73888, 54-8527, 54-11737, 56-150749, 57-78402, 63-285552, 1-1728, 1-19049 and 3-50555.

When the photoconductor is fabricated by providing a charge transport layer comprising the above-mentioned high-molecular weight charge transport material and a charge generation layer, the photosensitivity is considerably inferior to that of the photoconductor employing the low-molecular weight charge transport material.

SUMMARY OF THE INVENTION

Accordingly, an object of the present invention is to provide an electrophotographic photoconductor with extremely high sensitivity and minimum residual potential even after the repeated electrophotographic operations, and in addition, such a sufficient abrasion resistance that can prevent the photoconductive layer from being scraped off during the repeated electrophotographic operations.

The above-mentioned object of the present invention can be achieved by an electrophotographic photoconductor comprising an electroconductive support, and a photoconductive layer formed thereon comprising a charge generation material which comprises an azo pigment represented by formula (1):

(1)

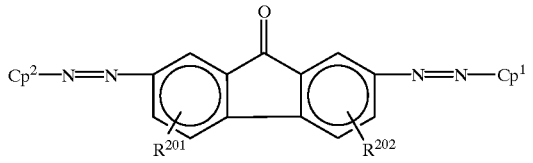

wherein $R^{201}$ and $R^{202}$, which may be the same or different, are each a hydrogen atom, a halogen atom, an alkyl group having 1 to 4 carbon atoms, an alkoxyl group having 1 to 4 carbon atoms or cyano group; and $Cp^1$ and $Cp^2$, which may be the same or different, are each a coupler radical represented by formula (2):

(2)

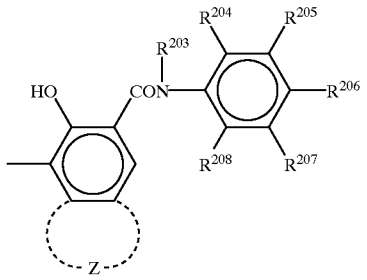

in which $R^{203}$ is a hydrogen atom, an alkyl group having 1 to 4 carbon atoms or an aryl group; $R^{204}$, $R^{205}$, $R^{206}$, $R^{207}$ and $R^{208}$ are each a hydrogen atom, nitro group, cyano group, a halogen atom, trifluoromethyl group, an alkyl group having 1 to 4 carbon atoms, an alkoxyl group having 1 to 4 carbon atoms, a dialkylamino group or hydroxyl group; and Z is an atomic group which constitutes a substituted or unsubstituted aromatic hydrocarbon ring, or a substituted or unsubstituted aromatic heterocyclic ring, the azo pigment showing a diffraction peak at a Bragg angle of 26.5±8° in the X-ray diffraction spectrum with respect to Cu—Kα ray, and a half-width of 2° or more in the peak at the Bragg angle of 26.5±0.8°.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
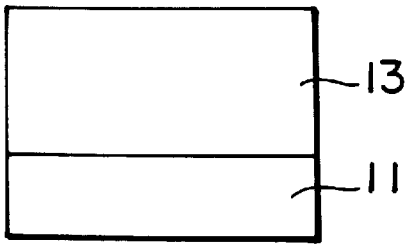
FIG. 1 is a schematic cross-sectional view which shows one example of an electrophotographic photoconductor according to the present invention.

As previously mentioned, the sensitivity of the electrophotographic photoconductor can be improved by increasing the quantum yield of free carriers and increasing the mobility of the materials. The increase of mobility depends on the material to be employed, in particular, a charge transport material, and the charge transport materials with excellent mobility have been already developed in order to satisfy such electrophotographic properties. Further, it is very difficult to increase the mobility simply by changing the design of the formulation for the photoconductor. Thus, the present invention has been accomplished in view of the increase of quantum yield of free carriers.

It has been believed that the photocarriers are generated in the photoconductive layer when the charge generation material is subjected to light excitation. The inventor of the present invention has studied the mechanism of generation of the photocarriers by using a bisazo pigment and a trisazo pigment as the charge generation materials in the electrophotographic photoconductor. As a result, excitons are generated in the charge generation layer by the application of light to the charge generation material such as a bisazo or trisazo pigment, and the excitons thus generated dissociate into free carriers at the interface between the charge generation layer and the charge transport layer, thereby generating the photocarriors. Such discovery is reported in "Japanese Journal of Applied Physics Vol. 29, No. 12, p. 2746–2750", and "Journal of Applied Physics Vol. 72, No. 1, p.117–123".

Furthermore, the inventor of the present invention has found the following facts:

(1) The generation of carriers at the interface between a charge generation layer (namely, a charge generation material) and a charge transport layer (namely, a charge transport material) can be seen in any organic charge generation materials.

(2) The quantity of generated photocarriers is increased when the contact density between a charge generation material and a low-molecular weight charge transport material is increased.

(3) The photocarriers can also be generated by the contact between a charge generation material and a high-molecular weight charge transport material. In this case, the more the contact density between the charge generation material and the high-molecular weight charge transport material, the more the quantity of generated photocarriers.

(4) The carriers are generated at the interface between a charge generation material and a charge transport material through at least two reaction steps. One is the formation of a geminate pair based on photo-induced electron transfer reaction, and the other is the dissociation of the geminate pair into free carriers.

In order to increase the quantum yield of free carriers, it is necessary to increase the reaction efficiency in each of the above-mentioned two steps. In the formation of the geminate pair, the reaction efficiency can be improved by increasing the contact density between the charge generation material and the charge transport material. In contrast to this, however, the process of dissociation of the geminate pair into free carriers has not yet been clarified, and the method for increasing the reaction efficiency in this process has not yet been found.

An electrophotographic photoconductor according to the present invention comprises an electroconductive support, and a photoconductive layer formed thereon comprising a charge generation material which comprises an azo pigment of formula (1):

(1)

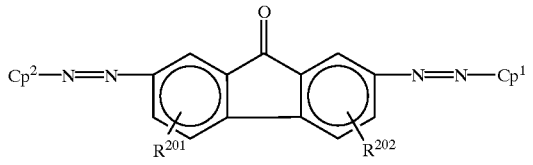

wherein $R^{201}$ and $R^{202}$, which may be the same or different, are each a hydrogen atom, a halogen atom, an alkyl group having 1 to 4 carbon atoms, an alkoxyl group having 1 to 4 carbon atoms or cyano group; and $Cp^1$ and $Cp^2$, which may be the same or different, are each a coupler radical represented by formula (2):

(2)

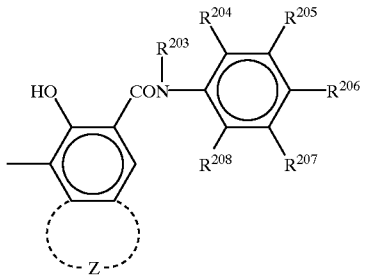

in which $R^{203}$ is a hydrogen atom, an alkyl group having 1 to 4 carbon atoms or an aryl group; $R^{204}$, $R^{205}$, $R^{206}$, $R^{207}$ and $R^{208}$ are each a hydrogen atom, nitro group, cyano group, a halogen atom, trifluoromethyl group, an alkyl group having 1 to 4 carbon atoms, an alkoxyl group having 1 to 4 carbon atoms, a dialkylamino group or hydroxyl group; and Z is an atomic group which constitutes a substituted or unsubstituted aromatic hydrocarbon ring, or a substituted or unsubstituted aromatic heterocyclic ring, with the above-mentioned also pigment showing a diffraction peak at a Bragg angle of 26.5±0.8° in the X-ray diffraction spectrum with respect to Cu—Kα ray, and a half-width of 2° or more in the peak at the Bragg angle of 26.5±0.8°.

In the formula (1), examples of the alkyl group represented by $R^{201}$ to $R^{208}$ are methyl group and ethyl group.

Examples of the alkoxyl group represented by $R^{201}$, $R^{202}$, $R^{204}$, $R^{205}$, $R^{206}$, $R^{207}$, and $R^{208}$ are methoxy group and ethoxy group.

There can be employed, for example, phenyl group as the aryl group represented by $R^{203}$.

Examples of the halogen atom represented by $R^{204}$, $R^{205}$, $R^{206}$, $R^{207}$ and $R^{208}$ are fluorine atom, chlorine atom, bromine atom and iodine atom.

Further, in the previously mentioned formula (2), Z represents a hydrocarbon ring such as benzene ring or naphthalene ring; or a heterocyclic ring such as indole ring, carbazole ring, benzofuran ring or dibenzofuran ring. The ring represented by Z may have as a substituent an alkyl group, an alkoxyl group, or a halogen atom such as chlorine or bromine.

In the photoconductor of the present invention, the reaction efficiency in the process of dissociation of the geminate pair into free carriers is excellent, so that the sensitivity of the obtained photoconductor becomes high. It is supposed by the results of experiments that the probability of dissociation into free carriers be extremely elevated when the above-mentioned azo pigment of formula (1) shows the specific crystal structure or the specific structure of an aggregate.

The aforementioned specific structure of the azo pigment can be confirmed by the X-ray diffraction spectrum. Namely, there can be employed any azo pigment of formula (1) so long as it shows a diffraction peak at a Bragg angle of 26.5±0.8° in the X-ray diffraction spectrum with respect to Cu—Kα ray, and a half-width of 2° or more at the Bragg angle of 26.5±0.8°. Therefore, the azo pigment of formula (1) is available as it is if it shows the above-mentioned specific structure immediately after synthesized. Even though the azo pigment of formula (1) does not show the above-mentioned specific structure when synthesized, the azo pigment may be subjected to treatment so as to adjust the crystal structure thereof. In this case, any conventional methods, for instance, wet-type method using a solvent and dry-type method by vacuum deposition, and mechanical treatment such as wet-type milling and dry-type milling are usable in the present invention.

Furthermore, in the azo pigment of formula (1), it is preferable that the coupler radicals represented by $Cp^1$ and $Cp^2$ be different In such a case, the molecular structure becomes unsymmetrical, and in general, the solubility of the thus obtained azo pigment is accordingly increased. The particle size of the azo pigment with unsymmetrical structure in a solid state becomes smaller than that of the azo pigment with symmetrical structure in which the coupler radicals $Cp^1$ and $Cp^2$ are the same. Therefore, the contact density between the azo pigment and the charge transport material is increased, so that the geminate pair can be generated more efficiently.

There are mainly two causes of the increase of residual potential after repeated electrophotographic operations. One is the decrease in the capability of transporting the photocarriers due to deterioration of the charge transport layer. The other is the decrease in the capability of generating the photocarriers. In terms of the former cause of the increase of residual potential, relatively effective charge transport materials have been developed in recent years. It is known that the development of such charge transport materials and the addition of a deterioration inhibitor can contribute to the improvement of the properties of the photoconductor.

The latter cause, that is, the decrease of capability of generating the photocarriers is mainly determined by the characteristics of a charge generation material to be employed. The charge generation material is required to sufficiently generate the photocarriers not only at the initial stage immediately after fabrication of the photoconductor, but also after repeated electrophotographic operations. The azo pigment for use in the present invention is considered to satisfy the above-mentioned requirements because it is physically and chemically stable and has a sufficient capability of generating the photocarriers.

Furthermore, in the present invention, the photoconductive layer may comprise a charge generation layer which comprises the above-mentioned azo pigment and a charge transport layer, the charge generation layer and the charge transport layer being successively overlaid on the electroconductive support. In such a case, it is preferable that the charge transport layer comprise at least one polycarbonate compound having a triarylamine structure on the main chain and/or side chain thereof, which serves as a charge transport material. When the charge transport layer comprises the above-mentioned high-molecular weight charge transport material, not only the mechanical durability of the charge transport layer can be maintained, but also the charge mobility can be increased because the density of charge transporting site can be increased. Therefore, the electrophotographic photoconductor of the present invention can be provided with such quick response to light as has never been achieved in the conventional photoconductor where the charge transport layer comprises a low-molecular weight charge transport material and an inert polymer.

For the measurement of the X-ray diffraction spectrum of the azo pigment, the commercially available measuring instrument can be used. The charge generation material prepared in a powdered state may be subjected to the measurement after extracted from the photoconductive layer. Alternatively, the photoconductive layer (or the charge generation layer in the case of a laminated type photoconductive layer) can be directly subjected to the measurement.

The structure of the electrophotographic photoconductor according to the present invention will now be explained in detail with reference to FIGS. 1 to 7. A photoconductive layer of a single-layered type is shown in FIGS. 1 to 3; whereas a photoconductive layer of a laminated type, in FIGS. 4 to 7.

FIG. 1 is a cross-sectional view which shows one example of the electrophotographic photoconductor according to the present invention. A photoconductor of FIG. 1 comprises an electroconductive support 11 and a photoconductive layer 13 which is overlaid on the electroconductive support 11 and comprises a charge generation material comprising the previously mentioned azo pigment of formula (1), a charge transport material and a binder resin.

Figure 2:
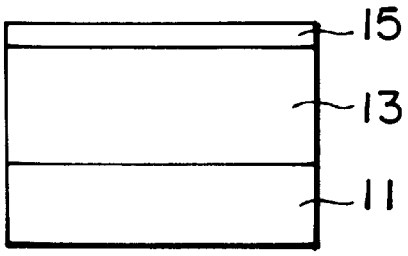
FIGS. 2 to 7 are schematic cross-sectional views which show another examples of an electrophotographic photoconductor according to the present invention.

An electrophotographic photoconductor shown in FIG. 2 further comprises a protective layer 15, which is overlaid on the above-mentioned photoconductive layer 13.

Figure 3:
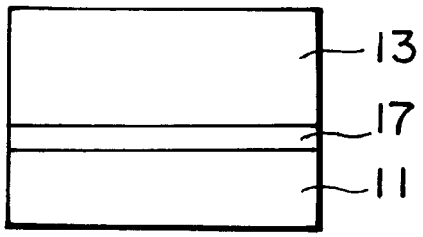

In an electrophotographic photoconductor shown in FIG. 3, an intermediate layer 17 is interposed between the electroconductive support 11 and the photoconductive layer 13.

Figure 4:
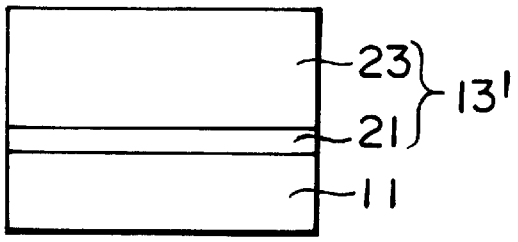

An electrophotographic photoconductor of FIG. 4 comprises an electroconductive support 11, and a photoconductive layer 13' comprising a charge generation layer 21 and a charge transport layer 23 which are successively overlaid on the electroconductive support 11 in this order.

Figure 5:
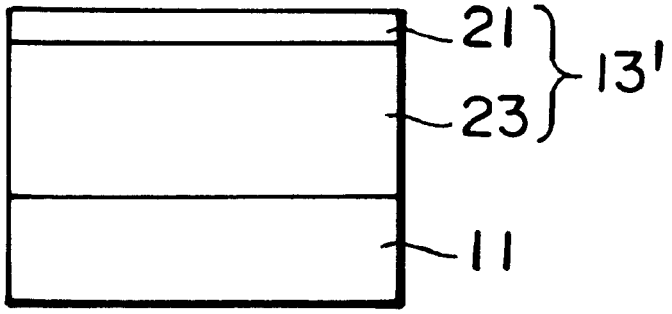

In an electrophotographic photoconductor of FIG. 5, the overlaying order of the charge generation layer 21 and the charge transport layer 23 is reversed when compared with the photoconductor of FIG. 4

Figure 6:
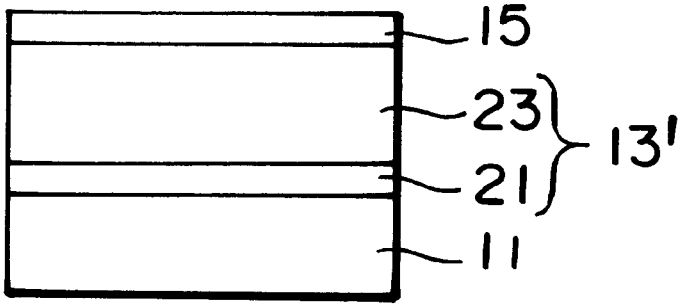

An electrophotographic photoconductor of FIG. 6 comprises an electroconductive support 11, and a charge generation layer 21, a charge transport layer 23 and a protective layer 15 which are successively overlaid on the electroconductive support 11 in this order.

Figure 7:
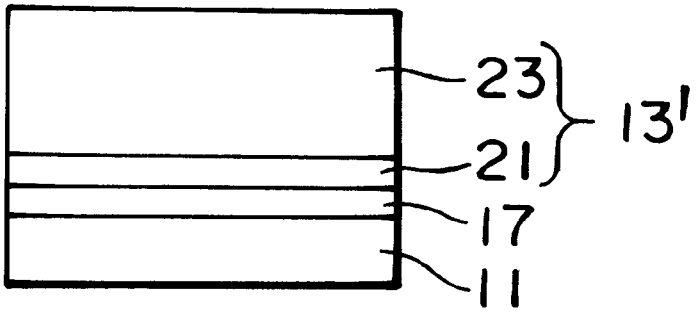

An electrophotographic photoconductor of FIG. 7 comprises an electroconductive support 11, and an intermediate layer 17, a charge generation layer 21 and a charge transport layer 23 which are successively overlaid on the electroconductive support 11 in this order.

The electroconductive support 11 may exhibit electroconductive properties, for example, have a volume resistivity of $1\times10^{10}$ Ω·cm or less. The electroconductive support 11 can be prepared by coating metals such as aluminum, nickel, chromium, copper, silver, gold and platinum, or metallic oxides such as tin oxide and indium oxide on a plastic film or a sheet of paper, which may be in the cylindrical form, by deposition or sputtering method. Alternatively, a plate of aluminum, aluminum alloys, nickel, or stainless steel may be formed into a tube by drawing and ironing (D.I.) method, impact ironing (I.I.) method, extrusion or pultrusion method. Subsequently, the tube thus obtained may be subjected to surface treatment such as cutting, superfinishing or abrasion to prepare the electroconductive support 11 for use in the photoconductor of the present invention.

The laminated photoconductive layer 13' will be explained in detail.

The charge generation layer 21 for use in the laminated photoconductive layer 13' comprises at least an azo pigment which is represented by formula (1) and forms such a specific crystal structure as to show a diffraction peak at a Bragg angle of 26.5±0.8° in the X-ray diffraction spectrum with respect to Cu—Kα ray, and a half-width of 2° or more in the peak at the Bragg angle of 26.5±0.8°.

The conventional charge generation materials may be used in combination with the previously mentioned azo pigment of formula (1).

Specific examples of the conventional charge generation materials for use in the present invention are phthalocyanine pigments such as metallo-phthalocyanine and metal-free phthalocyanine, azulenium salt pigments, squaric acid methyne pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bisstilbene skeleton, azo pigments having a distyryl oxadiazole skeleton, azo pigments having a distyryl carbazole skeleton, perylene pigments, anthraquinone pigments, polycyclic quinone pigments, quinone imine pigments, diphenylmethane pigments, triphenylmethane pigments, benzoquinone pigments, naphthoquinone pigments, cyanine pigments, azomethine pigments, indigoid pigments, and bisbenzimidazole pigments.

The charge generation layer 21 may further comprise an electrically inactive binder resin when necessary.

Examples of such an electrically inactive binder resin include polyamide, polyurethane, epoxy resin, polyketone, polycarbonate, silicone resin, acrylic resin, polyvinyl butyral, polyvinyl formal, polyvinylketone, polystyrene and polyacrylamide.

To prepare the charge generation layer 21, the charge generation material is dispersed, optionally in combination with the binder resin, in a proper solvent such as tetrahydrofuran, cyclohexanone, dioxane, 2-butanone or dichloroethane using a ball mill, attritor or sand mill. Then, the obtained dispersion is appropriately diluted to prepare a coating liquid for the charge generation layer 21. The thus prepared coating liquid is coated by dip coating, spray coating, or roller coating.

It is preferable that the thickness of the charge generation layer 21 be in the range of about 0.01 to 5 $\mu$m, and more preferably in the range of 0.1 to 2 $\mu$m.

To obtain the charge transport layer 23 for use in the present invention, a coating liquid is prepared by dissolving or dispersing a charge transport material and a binder resin in an appropriate solvent, and the thus prepared coating liquid is coated and dried.

The charge transport material for use in the charge transport layer includes a positive hole transport material and an electron transport material.

Examples of the electron transport material are conventional electron acceptor compounds such as chloroanil, bromoanil, tetracyanoethylene, tetracyanoquinodimethane, 2,4,7-trinitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide, and 3,5-dimethyl-3',5'-ditertiary butyl-4,4'-diphenoquinone.

Examples of the positive hole transport material are electron donor compounds such as poly-N-vinylcarbazole and derivatives thereof, poly-γ-carbazolylethyl glutamate and derivatives thereof, pyrene-formaldehyde condensation product and derivatives thereof, polyvinyl pyrene, polyvinyl phenanthrane, oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives and butadiene derivatives.

Further, in the charge transport layer 23, it is preferable to employ a high-molecular weight charge transport material which can also serve as the binder resin, that is, the previously mentioned polycarbonate compound having a triarylamine structure on the main chain and/or side chain thereof.

For instance, the following polycarbonate compounds of formulas (3) to (12) having a triarylamine structure on the main chain and/or side chain thereof are preferably employed:

The high-molecular weight polycarbonate of formula (3) will now be explained in detail.

(3)

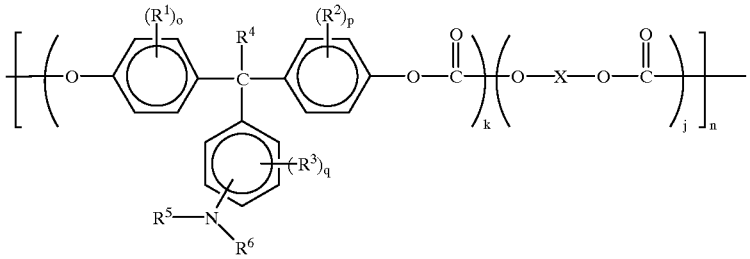

wherein $R^1$, $R^2$ and $R^3$ are each independently an alkyl group which may have a substituent or a halogen atom; $R^4$ is hydrogen atom or an alkyl group which may have a substituent; $R^5$ and $R^6$ are each independently an aryl group which may have a substituent; o, p and q are each independently an integer of 0 to 4; $0.1 \leqq k \leqq 1$; $0 \leqq j \leqq 0.9$; n is an integer of 5 to 5,000; and X is a bivalent aliphatic group, bivalent cyclic aliphatic group or a bivalent group represented by formula (3-a):

(3-a)

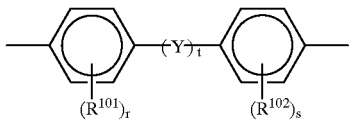

in which $R^{101}$ and $R^{102}$ may be the same or different, and are each independently an alkyl group which may have a substituent, an aryl group which may have a substituent or a halogen atom; r and s are each independently an integer of 0 to 4; t is an integer of 0 or 1, and when t=1, Y is a straight-chain, branched or cyclic alkylene group having 1 to 12 carbon atoms, —O—, —S—, —SO—, —$SO_2$—, —CO—, —CO—O—Z—O—CO— in which Z is a bivalent aliphatic group, or (3-b)

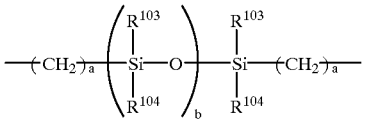

in which a is an integer of 1 to 20; b is an integer of 1 to 2,000; and $R^{103}$ and $R^{104}$, which may be the same or different, are each independently an alkyl group which may have a substituent or an aryl group which may have a substituent. In the above-mentioned formula (3) it is preferable that the alkyl group represented by $R^1$, $R^2$ and $R^3$ be a straight chain or branched alkyl group having 1 to 12 carbon atoms, more preferably having 1 to 8 carbon atoms, further preferably having 1 to 4 carbon atoms. The alkyl group may have a substituent such as a fluorine atom, hydroxyl group, cyano group, an alkoxyl group having 1 to 4 carbon atoms, or a phenyl group which may have a substituent selected from the group consisting of a halogen atom, an alkyl group having 1 to 4 carbon atoms, and an alkoxyl group having 1 to 4 carbon atoms.

Specific examples of the alkyl group represented by $R^1$, $R^2$ and $R^3$ are methyl group, ethyl group, n-propyl group, I-propyl group, t-butyl group, s-butyl group, n-butyl group, I-butyl group, trifluoromethyl group, 2-hydroxyethyl group, 2-cyanoethyl group, 2-ethoxyethyl group, 2-methoxyethyl group, benzyl group, 4-chlorobenzyl group, 4-methylbenzyl group, 4-methoxybenzyl group, and 4-phenylbenzyl group.

Examples of the halogen atom represented by $R^1$, $R^2$ and $R^3$ include fluorine atom, chlorine atom, bromine atom and iodine atom.

Specific examples of the substituted or unsubstituted alkyl group represented by $R^4$ are the same as those represented by $R^1$, $R^2$ and $R^3$ as mentioned above.

Examples of the aryl group represented by $R^5$ and $R^6$ are as follows:

(1) Aromatic hydrocarbon groups such as phenyl group;

(2) Condensed polycyclic groups such as naphthyl group, pyrenyl group, 2-fluorenyl group, 9,9-dimethyl-2-fluorenyl group, azurenyl group, anthryl group, triphenylenyl group, chrysenyl group, fluorenylidenephenyl group, and 5H-dibenzo[a,d]cycloheptenylidenephenyl group;

(3) Non-condensed polycyclic groups such as biphenylyl group and terphenylyl group; and (4) Heterocyclic groups such as thienyl group, benzothienyl group, furyl group, benzofuranyl group and carbazolyl group.

The above-mentioned aryl group may have a substituent. Examples of such a substituent for $R^5$ and $R^6$ are as follows:

(1) A halogen atom, cyano group, and nitro group.

(2) An alkyl group. There can be employed the same examples as mentioned in the explanation of $R^1$, $R^2$ and $R^3$.

(3) An alkoxyl group (—$OR^{108}$) in which $R^{109}$ is the same alkyl group as previously defined in (2).

Specific examples of such an alkoxyl group are methoxy group, ethoxy group, n-propoxy group, I-propoxy group, t-butoxy group, n-butoxy group, s-butoxy group, I-butoxy group, 2-hydroxyethoxy group, 2-cyanoethoxy group, benzyloxy group, 4-methylbenzyloxy group, and trifluoromethoxy group.

(4) An aryloxy group. Examples of the aryl group for use in the aryloxy group are phenyl group and naphthyl group. The aryloxy group may have a substituent such as an alkoxyl group having 1 to 4 carbon atoms, an alkyl group having 1 to 4 carbon atoms, or a halogen atom.

Specific examples of the aryloxy group are phenoxy group, 1-naphthyloxy group, 2-naphthyloxy group, 4-methylphenoxy group, 4-methoxyphenoxy group, 4-chlorophenoxy group, and 6-methyl-2-naphthyloxy group.

(5) A substituted mercapto group or an arylmercapto group.

Specific examples of the substituted mercapto group and arylmercapto group include methylthio group, ethylthio group, phenylthio group, and p-methylphenylthio group.

(6) An alkyl-substituted amino group. The same alkyl group as defined in (2) can be employed.

Specific examples of the alkyl-substituted amino group are dimethylamino group, diethylamino group, N-methyl-N-propylamino group, and N,N-dibenzylamino group.

(7) An acyl group such as acetyl group, propionyl group, butyryl group, malonyl group and benzoyl group.

Furthermore, the above-mentioned high-molecular weight compound of formula (3) can be produced in such a manner that a diol compound having triarylamino group represented by the following formula (3') is subjected to polymerization by the phosgene method or ester interchange method using a diol compound of formula (100) in combination, so that X is introduced into the main chain of the obtained compound:

(3')

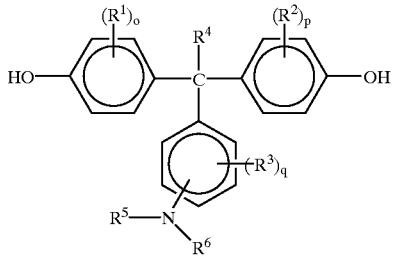

(100)

HO—X—OH wherein $R^1$ to $R^6$, o, p and q, and X are the same as those previously defined.

In this case, the obtained polycarbonate resin is in the form of a random copolymer or block copolymer.

Alternatively, X can also be introduced into the repeat unit of the polycarbonate resin by the polymerization reaction of the diol compound of formula (3') and a bischloroformate derived from the diol compound of formula (100). In this case, the polycarbonate resin in the form of an alternating copolymer can be obtained.

Examples of the diol compound represented by formula (100) include aliphatic diols such as 1,3-propanediol, 1,4-butanediol, 1,5-pentanediol, 1,6-hexanediol, 1,8-octanediol, 1,10-decanediol, 2-methyl-1,3-propanediol, 2,2-dimethyl-1,3-propanediol, 2-ethyl-1,3-propanediol, diethylene glycol, triethylene glycol, polyethylene glycol and polytetramethylene ether glycol; and cyclic aliphatic diols such as 1,4-cyclohexanediol, 1,3-cyclohexanediol and cyclohexane-1,4-dimethanol.

Examples of the diol compound having an aromatic ring are as follows: 4,4'-dihydroxydiphenyl, bis(4-hydroxyphenyl)methane, 1,1-bis(4-hydroxyphenyl)ethane, 1,1-bis(4-hydroxyphenyl)-1-phenylethane, 2,2-bis(4-hydroxyphenyl)propane, 2,2-bis(3-methyl-4-hydroxyphenyl)propane, 1,1-bis(4-hydroxyphenyl)cyclohexane, 1,1-bis(4-hydroxyphenyl)cyclopentane, 2,2-bis(3-phenyl-4-hydroxyphenyl)propane, 2,2-bis(3-isopropyl-4-hydroxyphenyl)propane, 2,2-bis(4-hydroxyphenyl)butane, 2,2-bis(3,5-dimethyl-4-hydroxyphenyl)propane, 2,2-bis(3,5-dibromo-4-hydroxyphenyl)propane, 4,4,'-dihydroxydiphenylsulfone, 4,4,'-dihydroxydiphenylsulfoxide, 4,4'-dihydroxydiphenylsulfide, 3,3'-dimethyl-4,4'-dihydroxydiphenyloulfide, 4,4'-dihydroxydiphenyloxide, 2,2-bis(4-hydroxyphenyl)hexafluoropropane, 9,9-bis(4-hydroxyphenyl)fluorene, 9,9-bis(4-hydroxyphenyl)xanthene, ethylene glycol-bis(4-hydroxybenzoate), diethylone glycol-bis(4-hydroxybenzoate), triethylene glycol-bis(4-hydroxybenzoate), 1,3-bis(4-hydroxyphenyl)tetramethyl disiloxane, and phenol-modified silicone oil.

The polycarbonate of formula (4) preferably used as the high-molecular weight charge transport material in the charge transport layer is as follows:

(4)

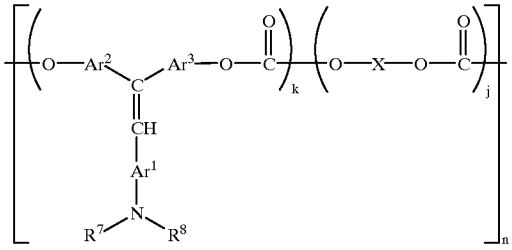

wherein $R^7$ and $R^8$ are each independently an aryl group which may have a substituent; $Ar^1$, $Ar^2$ and $Ar^3$, which may be the same or different, are each independently an arylene group; $0.1 \leqq k \leqq 1$; $0 \leqq j \leqq 0.9$; n is an integer of 5 to 5,000; and X is the same as that previously defined in formula (3).

Examples of the aryl group represented by $R^7$ and $R^8$ are as follows:

(1) Aromatic hydrocarbon groups such as phenyl group;

(2) Condensed polycyclic groups such as naphthyl group, pyrenyl group, 2-fluorenyl group, 9,9-dimethyl-2-fluorenyl group, azurenyl group, anthryl group, triphenylenyl group, chrysenyl group, fluorenylidenephenyl group, and 5H-dibenzo[a,d]cycloheptenylidenephenyl group;

(3) Non-condensed polycyclic groups such as biphenylyl group, terphenylyl group, and a group of the following formula:

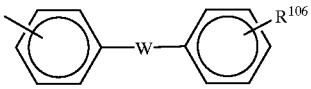

wherein w is —O—, —S—, —SO—, —$SO_2$—, —CO—, $-(CH_2)_c-$ in which c is an integer of 1 to 12, $-(CH{=}CH)_d-$ in which d is an integer of 1 to 3,

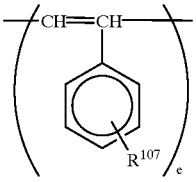

in which e is an integer of 1 to 3, or

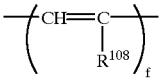

in which f is an integer of 1 to 3; and (4) Heterocyclic groups such as thienyl group, benzothienyl group, furyl group, benzofuranyl group and carbazolyl group.

As the arylene group represented by $Ar^1$, $Ar^2$ and $Ar^3$, there can be employed bivalent groups derived from the above-mentioned examples of the aryl group represented by $R^7$ and $R^8$.

The above-mentioned aryl group and arylene group may have a substituent. The above $R^{106}$, $R^{107}$ and $R^{108}$ also represent the same examples of the substituent to be listed below.

Examples of the substituent for $R^7$, $R^8$, $Ar^1$, $Ar^2$ and $Ar^3$ are as follows:

(1) A halogen atom, cyano group, and nitro group.

(2) An alkyl group, preferably a straight chain or branched alkyl group having 1 to 12 carbon atoms, more preferably having 1 to 8 carbon atoms, further preferably having 1 to 4 carbon atoms. The alkyl group may have a substituent such as a fluorine atom, hydroxyl group, cyano group, an alkoxyl group having 1 to 4 carbon atoms, or a phenyl group which may have a substituent selected from the group consisting of a halogen atom, an alkyl group having 1 to 4 carbon atoms, and an alkoxyl group having 1 to 4 carbon atoms.

Specific examples of such an alkyl group are methyl group, ethyl group, n-propyl group, I-propyl group, t-butyl group, s-butyl group, n-butyl group, I-butyl group, trifluoromethyl group, 2-hydroxyethyl group, 2-cyanoethyl group, 2-ethoxyethyl group, 2-methoxyethyl group, benzyl group, 4-chlorobenzyl group, 4-methylbenzyl group, 4-methoxybenzyl group, and 4-phenylbenzyl group.

(3) An alkoxyl group (—$OR^{109}$) in which $R^{109}$ is the same alkyl group as previously defined in (2).

Specific examples of such an alkoxyl group are methoxy group, ethoxy group, n-propoxy group, I-propoxy group, t-butoxy group, n-butoxy group, s-butoxy group, I-butoxy group, 2-hydroxyethoxy group, 2-cyanoethoxy group, benzyloxy group, 4-methylbenzyloxy group, and trifluoromethoxy group.

(4) An aryloxy group. Examples of the aryl group for use in the aryloxy group are phenyl group and naphthyl group. The aryloxy group may have a substituent such as an alkoxyl group having 1 to 4 carbon atoms, an alkyl group having 1 to 4 carbon atoms, or a halogen atom.

Specific examples of the aryloxy group are phenoxy group, 1-naphthyloxy group, 2-naphthyloxy group, 4-methylphenoxy group, 4-methoxyphenoxy group, 4-chlorophenoxy group, and 6-methyl-2-naphthyloxy group.

(5) A substituted mercapto group or an arylmercapto group.

Specific examples of the substituted mercapto group and arylmercapto group include methylthio group, ethylthio group, phenylthio group, and p-methylphenylthio group.

(6) An alkyl-substituted amino group represented by the following formula:

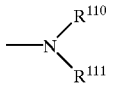

wherein $R^{110}$ and $R^{111}$ are each independently the same examples of the alkyl group as defined in (2) or an aryl group, such as phenyl group, biphenyl group, or naphthyl group.

This group may have a substituent such as an alkoxyl group having 1 to 4 carbon atoms, an alkyl group having 1 to 4 carbon atoms or a halogen atom. $R^{110}$ and $R^{111}$ may form a ring in combination with the carbon atoms of the aryl group.

Specific examples of the above-mentioned alkyl-substituted amino group are diethylamino group, N-methyl-N-phenylamino group, N,N-diphenylamino group, N,N-di(p-tolyl)amino group, dibenzylamino group, piperidino group, morpholino group and julolidyl group.

(7) An alkylenedioxy group such as methylenedioxy group, and an alkylenedithio group such as methylenedithio group.

Furthermore, the above-mentioned high-molecular weight compound of formula (4) can be produced in such a manner that a diol compound having triarylamino group represented by the following formula (4') is subjected to polymerization by the phosgene method or ester interchange method using a diol compound of formula (100) in combination, so that X is introduced into the main chain of the obtained compound:

(4')

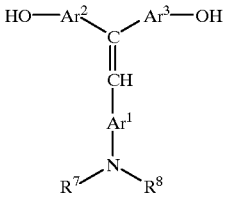

HO—X—OH (100)

wherein $Ar^1$ to $Ar^3$, $R^7$ and $R^8$ and X are the same as those previously defined.

In this case, the obtained polycarbonate resin is in the form of a random copolymer or block copolymer.

Alternatively, X can also be introduced into the repeat unit of the polycarbonate resin by the polymerization reaction of the diol compound of formula (4') and a bischloroformate derived from the diol compound of formula (100). In this case, the polycarbonate resin in the form of an alternating copolymer can be obtained.

The same diol compounds as mentioned in formula (3) can also be employed as the diol compound of formula (100).

The high-molecular weight compound of formula (5), that is, one of the polycarbonate compounds preferably used in the charge transport layer, will now be described in detail.

(5)

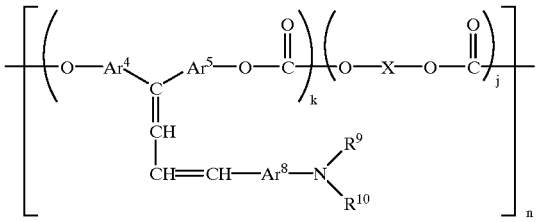

wherein $R^9$ and $R^{10}$ are each independently an aryl group which may have a substituent; $Ar^4$, $Ar^5$ and $Ar^6$, which may be the same or different, are each independently an arylene group; $0.1 \leqq k \leqq 1$; $0 \leqq j \leqq 0.9$; n is an integer of 5 to 5,000; and X is the same as that previously defined in formula (3).

Examples of the aryl group represented by $R^9$ and $R^{10}$ are as follows:

(1) Aromatic hydrocarbon groups such as phenyl group;

(2) Condensed polycyclic groups such as naphthyl group, pyrenyl group, 2-fluorenyl group, 9,9-dimethyl-2-fluorenyl group, azurenyl group, anthryl group, triphenylenyl group, chrysenyl group, fluorenylidenephenyl group, and 5H-dibenzo[a,d]cycloheptenylidenephenyl group;

(3) Non-condensed polycyclic groups such as biphenylyl group and terphenylyl group; and (4) Heterocyclic groups such as thienyl group, benzothienyl group, furyl group, benzofuranyl group and carbazolyl group.

As the arylene group represented by $Ar^4$, $Ar^5$ and $Ar^6$, there can be employed bivalent groups derived from the above-mentioned examples of the aryl group represented by $R^9$ and $R^{10}$.

The above-mentioned aryl group and arylene group may have a substituent.

Examples of such a substituent for $R^9$, $R^{10}$, $Ar^4$, $Ar^5$ and $Ar^6$ are as follows:

(1) A halogen atom, cyano group, and nitro group.

(2) An alkyl group, preferably a straight chain or branched alkyl group having 1 to 12 carbon atoms, more preferably having 1 to 8 carbon atoms, further preferably having 1 to 4 carbon atoms. The alkyl group may have a substituent such as a fluorine atom, hydroxyl group, cyano group, an alkoxyl group having 1 to 4 carbon atoms, or a phenyl group which may have a substituent selected from the group consisting of a halogen atom, an alkyl group having 1 to 4 carbon atoms, and an alkoxyl group having 1 to 4 carbon atoms.

Specific examples of such an alkyl group are methyl group, ethyl group, n-propyl group, I-propyl group, t-butyl group, s-butyl group, n-butyl group, I-butyl group, trifluoromethyl group, 2-hydroxyethyl group, 2-cyanoethyl group, 2-ethoxyethyl group, 2-methoxyethyl group, benzyl group, 4-chlorobenzyl group, 4-methylbenzyl group, 4-methoxybenzyl group, and 4-phenylbenzyl group.

(3) An alkoxyl group ($-OR^{112}$) in which $R^{112}$ is the same alkyl group as previously defined in (2).

Specific examples of such an alkoxyl group are methoxy group, ethoxy group, n-propoxy group, I-propoxy group, t-butoxy group, n-butoxy group, s-butoxy group, I-butoxy group, 2-hydroxyethoxy group, 2-cyanoethoxy group, benzyloxy group, 4-methylbenzyloxy group, and trifluoromethoxy group.

(4) An aryloxy group. Examples of the aryl group for use in the aryloxy group are phenyl group and naphthyl group. The aryloxy group may have a substituent such as an alkoxyl group having 1 to 4 carbon atoms, an alkyl group having 1 to 4 carbon atoms, or a halogen atom.

Specific examples of the aryloxy group are phenoxy group, 1-naphthyloxy group, 2-naphthyloxy group, 4-methylphenoxy group, 4-methoxyphenoxy group, 4-chlorophenoxy group, and 6-methyl-2-naphthyloxy group.

(5) A substituted mercapto group or an arylmercapto group.

Specific examples of the substituted mercapto group and arylmercapto group include methylthio group, ethylthio group, phenylthio group, and p-methylphenylthio group.

(6) An alkyl-substituted amino group. The same alkyl group as defined in (2) can be employed.

Specific examples of the alkyl-substituted amino group are dimethylamino group, diethylamino group, N-methyl-N-propylamino group, and N,N-dibenzylamino group.

(7) An acyl group such as acetyl-group, propionyl group, butyryl group, malonyl group and benzoyl group.

Furthermore, the above-mentioned high-molecular weight compound of formula (5) can be produced in such a manner that a diol compound having triarylamino group represented by the following formula (5') is subjected to polymerization by the phosgene method or ester interchange method using a diol compound of formula (100) in combination, so that X is introduced into the main chain of the obtained compounds (5')

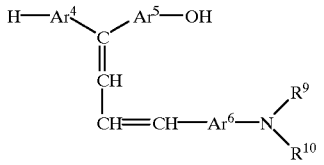

(100)

wherein $R^9$ and $R^{10}$, $Ar^4$ to $Ar^6$, and X are the same as those previously defined.

In this case, the obtained polycarbonate resin is in the form of a random copolymer or block copolymer.

Alternatively, X can also be introduced into the repeat unit of the polycarbonate resin by the polymerization reaction of the diol compound of formula (5') and a bischloroformate derived from the diol compound of formula (100). In this case, the polycarbonate resin in the form of an alternating copolymer can be obtained.

The same diol compounds as mentioned in formula (3) can also be employed as the diol compound of formula (100).

The high-molecular weight compound of formula (6) will now be described in detail.

(6)

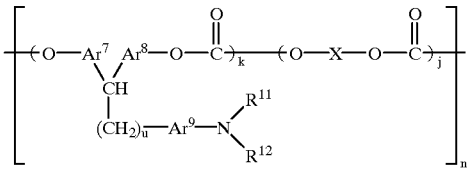

wherein $R^{11}$ and $R^{12}$ are each independently an aryl group which may have a substituent; $Ar^7$, $Ar^8$ and $Ar^9$, which may be the same or different, are each independently an arylene group; u is an integer of 1 to 5; $0.1 \leqq k \leqq 1$; $0 \leqq j \leqq 0.9$; n is an integer of 5 to 5,000; and X is the same as that previously defined in formula (3).

Examples of the aryl group represented by $R^{11}$ and $R^{12}$ are the same as those represented by $R^9$ and $R^{10}$ mentioned in the compound of formula (5).

As the arylene group represented by $Ar^7$, $Ar^8$ and $Ar^9$, there can be employed bivalent groups derived from the above-mentioned examples of the aryl group represented by $R^{11}$ and $R^{12}$.

The above-mentioned aryl group and arylene group may have a substituent.

The same substituents for the aryl group and arylene group as mentioned in the compound of formula (5) can be employed for $R^{11}$, $R^{12}$, $Ar^7$, $Ar^8$ and $Ar^9$.

Furthermore, the above-mentioned high-molecular weight compound of formula (6) can be produced in such a manner that a diol compound having triarylamino group represented by the following formula (6') is subjected to polymerization by the phosgene method or ester interchange method using a diol compound of formula (100) in combination, so that X is introduced into the main chain of the obtained compound:

(6')

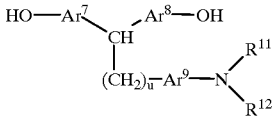

(100)

wherein $R^{11}$ and $R^{12}$, $Ar^7$ to $Ar^9$, u, and X are the same as those previously defined.

In this case, the obtained polycarbonate resin is in the form of a random copolymer or block copolymer.

Alternatively, X can also be introduced into the repeat unit of the polycarbonate resin by the polymerization reaction of the diol compound of formula (6') and a bischloroformate derived from the diol compound of formula (100). In this case, the polycarbonate resin in the form of an alternating copolymer can be obtained.

The same diol compounds as mentioned in formula (3) can also be employed as the diol compound of formula (100).

The high-molecular weight compound of formula (7) will now be described in detail.

(7)

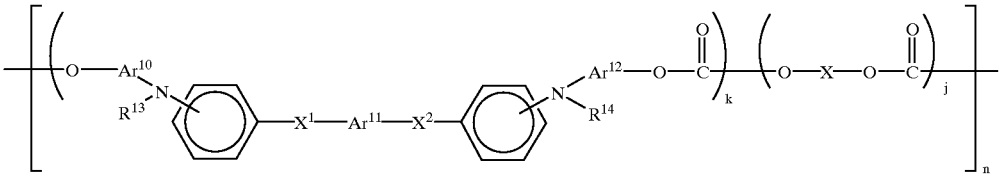

wherein $R^{13}$ and $R^{14}$ are each independently an aryl group which may have a substituent; $Ar^{10}$, $Ar^{11}$ and $Ar^{12}$, which may be the same or different, are each independently an arylene group; $X^1$ and $X^2$ are each independently ethylene group which may have a substituent or vinylene group which may have a substituent; $0.1 \leqq k \leqq 1$; $0 \leqq j \leqq 0.9$; n is an integer of 5 to 5,000; and X is the same as that previously defined in formula (3).

Examples of the aryl group represented by $R^{13}$ and $R^{14}$ are the same as those represented by $R^9$ and $R^{10}$ mentioned in the compound of formula (5).

As the arylene group represented by $Ar^{10}$, $Ar^{11}$ and $Ar^{12}$, there can be employed bivalent groups derived from the above-mentioned examples of the aryl group represented by $R^{13}$ and $R^{14}$.

The above-mentioned aryl group and arylene group may have a substituent.

The same substituents for the aryl group and arylene group as mentioned in the compound of formula (5) can be employed for $R^{13}$, $R^{14}$, $Ar^{10}$, $Ar^{11}$ and $Ar^{12}$.

Examples of the substituent for ethylene group or vinylene group represented by $X^1$and $X^2$ include cyano group, a halogen atom, nitro group, the same aryl group as represented by $R^{13}$ and $R^{14}$, and the same alkyl group serving as the substituent for the aryl group or arylene group represented by $R^{13}$, $R^{14}$, $Ar^{10}$, $Ar^{11}$ and $Ar^{12}$.

Furthermore, the above-mentioned high-molecular weight compound of formula (7) can be produced in such a manner that a diol compound having triarylamino group represented by the following formula (7') is subjected to polymerization by the phosgene method or ester interchange method using a diol compound of formula (100) in combination, so that X is introduced into the main chain of the obtained compounds;

(7')

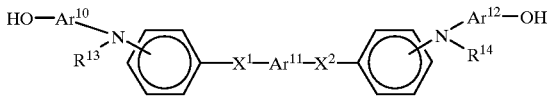

(100)

HO—X—OH wherein $R^{13}$ and $R^{14}$, $Ar^{10}$ to $Ar^{12}$, $X^1$ and $X^2$, and X are the same as those previously defined.

In this case, the obtained polycarbonate resin is in the form of a random copolymer or block copolymer.

Alternatively, X can also be introduced into the repeat unit of the polycarbonate resin by the polymerization reaction of the diol compound of formula (7') and a bischloroformate derived from the diol compound of formula (100). In this case, the polycarbonate resin in the form of an alternating copolymer can be obtained.

The same diol compounds as mentioned in formula (3) can also be employed as the diol compound of formula (100).

The high-molecular weight compound of formula (8) will now be described in detail.

(8)

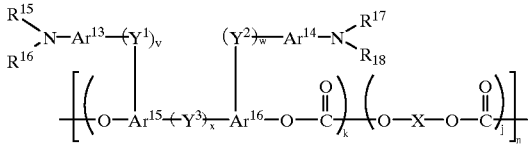

wherein $R^{15}$, $R^{16}$, $R^{17}$ and $R^{18}$ are each independently an aryl group which may have a substituent; $Ar^{13}$, $Ar^{14}$, $Ar^{15}$ and $Ar^{16}$, which may be the same or different, are each independently an arylene group; v, w and x are each independently an integer of 0 or 1, and when v, w and x are an integer of 1, $Y^1$, $Y^2$ and $Y^3$, which may be the same or different, are each independently an alkylene group which may have a substituent, a cycloalkylene group which may have a substituent, an alkylene ether group which may have a substituent, oxygen atom, sulfur atom, or vinylene group; $0.1 \leqq k \leqq 1$; $0 \leqq j \leqq 0.9$; n is an integer of 5 to 5,000; and X is the same as that previously defined in formula (3).

Examples of the aryl group represented by $R^{15}$ to $R^{16}$ are the same as those represented by $R^9$ and $R^{10}$ mentioned in the compound of formula (5).

As the arylene group represented by $Ar^{13}$ to $Ar^{16}$, there can be employed bivalent groups derived from the above-mentioned examples of the aryl group represented by $R^{18}$ to $R^{19}$.

The above-mentioned aryl group and arylene group may have a substituent, such as a halogen atom, cyano group, nitro group, an alkyl group, an alkoxyl group, and an aryloxy group. With respect to each of the above-mentioned substituents, the same examples as explained in the compound of formula (5) can be employed.

When $Y^1$ to $Y^3$ are each independently an alkylene group, there can be employed bivalent groups derived from the examples of the alkyl group as the substituent for the aryl group or arylene group represented by $R^{15}$ to $R^{16}$ and $Ar^{13}$ to $Ar^{16}$.

Specific examples of the alkylene group represented by $Y^1$ to $Y^3$ are methylene group, ethylene group, 1,3-propylene group, 1,4-butylene group, 2-methyl-1,3-propylene group, difluoromethylene group, hydroxyethylene group, cyanoethylene group, methoxyethylene group, phenylmethylene group, 4-methylphenylmethylene group, 2,2-propylene group, 2,2-butylene group and diphenylmethylene group.

Examples of the cycloalkylene group represented by $Y^1$ to $Y^3$ are 1,1-cyclopentylene group, 1,1-cyclohexylene group and 1,1-cyclooctylene group.

Examples of the alkylene other group represented by $Y^1$ to $Y^3$ are dimethylene ether group, diethylene ether group, ethylene methylene ether group, bis(triethylene)ether group, and polytetramethylene ether group.

Furthermore, the above-mentioned high-molecular weight compound of formula (8) can be produced in such a manner that a diol compound having triarylamino group represented by the following formula (8') is subjected to polymerization by the phosgene method or ester interchange method using a diol compound of formula (100) in combination, so that X is introduced into the main chain of the obtained compound:

(8')

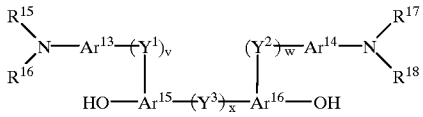

(100)

wherein $R^{15}$ to $R^{18}$, $Ar^{13}$ to $Ar^{14}$, $Y^1$ to $Y^3$, v, w, x and X are the same as those previously defined.

In this case, the obtained polycarbonate resin is in the form of a random copolymer or block copolymer.

Alternatively, X can also be introduced into the repeat unit of the polycarbonate resin by the polymerization reaction of the dial compound of formula (8') and a bischloroformate derived from the dial compound of formula (100). In this case, the polycarbonate resin in the form of an alternating copolymer can be obtained.

The same dial compounds as mentioned in formula (3) can also be employed as the dial compound of formula (100).

The high-molecular weight compound of formula (9) will now be described in detail.

(9)

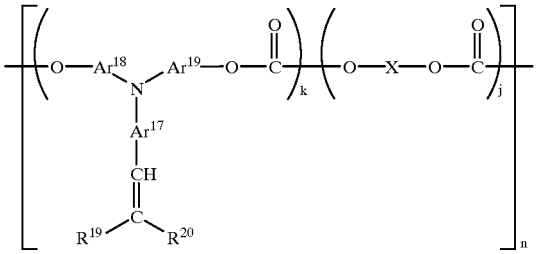

wherein $R^{19}$ and $R^{20}$ are each independently a hydrogen atom, or an aryl group which may have a substituent, and $R^{19}$ and $R^{20}$ may form a ring in combination; $Ar^{17}$, $Ar^{18}$ and $Ar^{19}$, which may be the same or different, are each independently an arylene group; $0.1 \leqq k \leqq 1$; $0 \leqq j \leqq 0.9$; n is an integer of 5 to 5,000; and X is the same as that previously defined in formula (3).

Examples of the aryl group represented by $R^{19}$ and $R^{20}$ are the same as those represented by $R^9$ and $R^{10}$ mentioned in the compound of formula (5). In addition, $R^{19}$ and $R^{20}$ may form a ring such as 9-fluorenylidene or 5H-dibenzo[a, d]cycloheptenylidene As the arylene group represented by $Ar^{17}$ to $Ar^{19}$, there can be employed bivalent groups derived from the above-mentioned examples of the aryl group represented by $R^{19}$ and $R^{20}$.

The above-mentioned aryl group and arylene group may have a substituent.

The same substituents for the aryl group and arylene group as mentioned in the compound of formula (5) can be employed for $R^{19}$ and $R^{20}$ and $Ar^{17}$ to $Ar^{18}$.

Furthermore, the above-mentioned high-molecular weight compound of formula (9) can be produced in such a manner that a diol compound having triarylamino group represented by the following formula (9') is subjected to polymerization by the phosgene method or ester interchange method using a diol compound of formula (100) in combination, so that X is introduced into the main chain of the obtained compound:

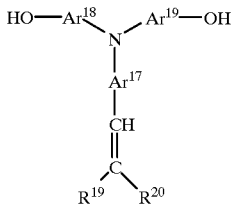

(9')

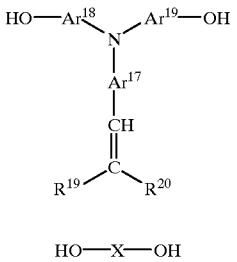

(100)

wherein $R^{19}$ and $R^{20}$, $Ar^{17}$ to $Ar^{19}$, and X are the same as those previously defined.

In this case, the obtained polycarbonate resin is in the form of a random copolymer or block copolymer.

Alternatively, X can also be introduced into the repeat unit of the polycarbonate resin by the polymerization reaction of the diol compound of formula (9') and a bischloroformate derived from the diol compound of formula (100). In this case, the polycarbonate resin in the form of an alternating copolymer can be obtained.

The same diol compounds as mentioned in formula (3) can also be employed as the diol compound of formula (100).

The high-molecular weight compound of formula (10) will now be described in detail.

(10)

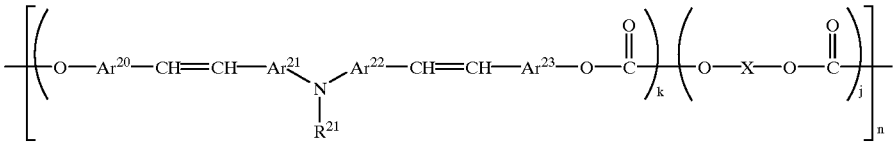

wherein $R^{21}$ is an aryl group which may have a substituent; $Ar^{20}$, $Ar^{21}$, $Ar^{22}$ and $Ar^{23}$, which may be the same or different, are each independently an arylene group; $0.1 \leqq k \leqq 1$; $0 \leqq j \leqq 0.9$; n is an integer of 5 to 5,000; and X is the same as that previously defined in formula (3).

Examples of the aryl group represented by $R^{21}$ are the same as those represented by $R^9$ and $R^{10}$ mentioned in the compound of formula (5).

As the arylene group represented by $Ar^{20}$ to $Ar^{23}$, there can be employed bivalent groups derived from the above-mentioned examples of the aryl group represented by $R^{21}$.

The above-mentioned aryl group and arylene group may have a substituent.

The same substituents for the aryl group and arylene group as mentioned in the compound of formula (5) can be employed for $R^{21}$ and $Ar^{20}$ to $Ar^{23}$.

Furthermore, the above-mentioned high-molecular weight compound of formula (10) can be produced in such a manner that a diol compound having triarylamino group represented by the following formula (10') is subjected to polymerization by the phosgene method or ester interchange method using a diol compound of formula (100) in combination, so that X is introduced into the main chain of the obtained compound:

(10')

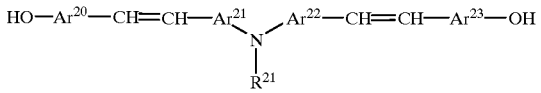

(100)

wherein $R^{21}$, $Ar^{20}$ to $Ar^{23}$, and X are the same as those previously defined.

In this case, the obtained polycarbonate resin is in the form of a random copolymer or block copolymer.

Alternatively, X can also be introduced into the repeat unit of the polycarbonate resin by the polymerization reaction of the diol compound of formula (10') and a bischloroformate derived from the diol compound of formula (100). In this case, the polycarbonate resin in the form of an alternating copolymer can be obtained.

The same diol compounds as mentioned in formula (3) can also be employed as the diol compound of formula (100).

The high-molecular weight compound of formula (11) will now be described in detail.

(11)

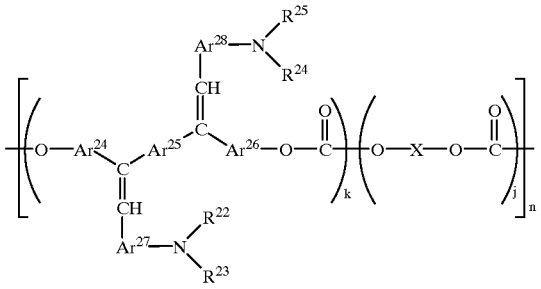

wherein $R^{22}$, $R^{23}$, $R^{24}$ and $R^{25}$ are each independently an aryl group which may have a substituent; $Ar^{24}$, $Ar^{25}$, $Ar^{26}$, $Ar^{27}$ and $Ar^{28}$, which may be the same or different, are each independently an arylene group; $0.1 \leqq k \leqq 1$; $0 \leqq j \leqq 0.9$; n is an integer of 5 to 5,000; and X is the same as that previously defined in formula (3).

Examples of the aryl group represented by $R^{22}$, $R^{23}$, $R^{24}$ and $R^{25}$ are the same as those represented by $R^9$ and $R^{10}$ mentioned in the compound of formula (5).

As the arylene group represented by $Ar^{24}$ to $Ar^{20}$, there can be employed bivalent groups derived from the above-mentioned examples of the aryl group represented by $R^{22}$ to $R^{25}$.

The above-mentioned aryl group and arylene group may have a substituent.

The same substituents for the aryl group and arylene group as mentioned in the compound of formula (5) can be employed for $R^{22}$ to $R^{25}$ and $Ar^{24}$ to $Ar^{28}$.

Furthermore, the above-mentioned high-molecular weight compound of formula (11) can be produced in such a manner that a diol compound having triarylamino group represented by the following formula (11') is subjected to polymerization by the phosgene method or ester interchange method using a diol compound of formula (100) in combination, so that X is introduced into the main chain of the obtained compounds (11')

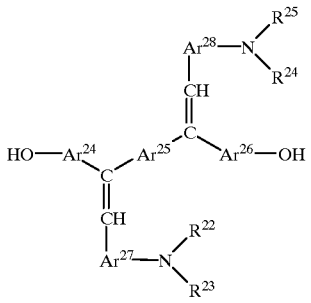

(100)

wherein $R^{22}$ to $R^{25}$, $Ar^{24}$ to $Ar^{29}$, and X are the same as those previously defined.

In this case, the obtained polycarbonate resin is in the form of a random copolymer or block copolymer.

Alternatively, X can also be introduced into the repeat unit of the polycarbonate resin by the polymerization reaction of the diol compound of formula (11') and a bischloroformate derived from the diol compound of formula (100). In this case, the polycarbonate resin in the form of an alternating copolymer can be obtained.

The same diol compounds as mentioned in formula (3) can also be employed as the diol compound of formula (100).

The high-molecular weight compound of formula (12) will now be described in detail.

(12)

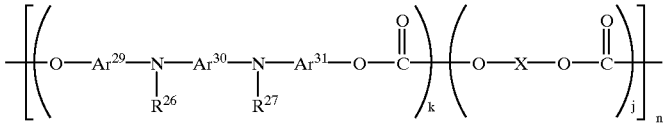

wherein $R^{26}$ and $R^{27}$ are each independently an aryl group which may have a substituent; $Ar^{29}$, $Ar^{30}$ and $Ar^{31}$, which may be the same or different, are each independently an arylene group; $0.1 \leqq k \leqq 1$; $0 \leqq j \leqq 0.9$; n is an integer of 5 to 5,000; and X is the same as that previously defined in formula (3).

Examples of the aryl group represented by $R^{26}$ and $R^{27}$ are the same as those represented by $R^9$ and $R^{10}$ mentioned in the compound of formula (5).

As the arylene group represented by $Ar^{29}$ to $Ar^{31}$, there can be employed bivalent groups derived from the above-mentioned examples of the aryl group represented by $R^{26}$ and $R^{27}$.

The above-mentioned aryl group and arylene group may have a substituent.

The same substituents for the aryl group and arylene group as mentioned in the compound of formula (5) can be employed for $R^{26}$ and $R^{27}$ and $Ar^{29}$ to $Ar^{32}$.

Furthermore, the above-mentioned high-molecular weight compound of formula (12) may be produced in such a manner that a diol compound having triarylamino group represented by the following formula (12') is subjected to polymerization by the phosgene method or ester interchange method using a diol compound of formula (100) in combination, so that X is introduced into the main chain of the obtained compound;

(12')

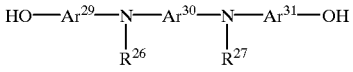

(100)

wherein $R^{26}$ and $R^{27}$, $Ar^{29}$ to $Ar^{31}$, and X are the same as those previously defined.

In this case, the obtained polycarbonate resin is in the form of a random copolymer or block copolymer.

Alternatively, X can also be introduced into the repeat unit of the polycarbonate resin by the polymerization reaction of the diol compound of formula (12') and a bischloroformate derived from the diol compound of formula (100). In this case, the polycarbonate resin in the form of an alternating copolymer can be obtained.

The same diol compounds as mentioned in formula (3) can also be employed as the diol compound of formula (100).

Those charge transport materials may be used alone or in combination. Further, such a high-molecular weight charge transport material may be used together with the previously mentioned low-molecular weight charge transport material in the charge transport layer 23.

The charge transport layer 23 may further comprise a plasticizer and a leveling agent when necessary.

When the single-layered photoconductive layer 13 is prepared, the charge generation material comprising the previously mentioned azo pigment and the charge transport material may be dispersed, optionally in combination with a binder resin, in a proper solvent such as tetrahydrofuran, cyclohexanone, dioxane, 2-butanone or dichloroethane using a ball mill, attritor or sand mill. The thus prepared dispersion may be appropriately diluted, whereby a coating liquid for the photoconductive layer 13 can be prepared. The coating liquid thus prepared may be coated by dip coating, spray coating or roller coating, for instance, on the electroconductive support 11 to provide the photoconductor shown in FIG. 1.

When the binder resin is used for the formation of the photoconductive layer 13, the same binder resin as employed in the formation of the charge transport layer 23 can be preferably employed, which may be used in combination with the same binder resin as in the formation of the charge generation layer 21.

The same charge transport materials as mentioned in the charge transport layer 23 can be employed as the charge transport materials in the single-layered photoconductive layer 13.

The previously mentioned high-molecular weight charge transport material which can also serve as the binder resin is preferably used as the charge transport material in the photoconductive layer 13. In this case, the above-mentioned polycarbonate compounds of formulas (3) to (12) are preferably used.

The photoconductive layer 13 may further comprise a plasticizer and a leveling agent when necessary.

Any plasticizers that are contained in the general-purpose resins, such as dibutyl phthalate and dioctyl phthalate can be used as they are. It is proper that the amount of plasticizer be in the range of 0 to about 30 parts by weight to 100 parts by weight of the binder resin.

As the leveling agent for use in the charge transport layer 23 and the photoconductive layer 13, there can be employed silicone oils such as dimethyl silicone oil and methylphenyl silicone oil, and polymers and oligomers having a perfluoroalkyl group on the side chain thereof. The proper amount of leveling agent is at most one part by weight to 100 parts by weight of the binder resin.

In the electrophotographic photoconductor of the present invention, an antioxidant may be contained in any layer that comprises an organic material in order to improve the environmental resistance, to be more specific, to prevent the decrease of photosensitivity and the increase of residual potential. In particular, satisfactory results can be obtained when the antioxidant is added to the layer which comprises the charge transport material.

Conventionally known antioxidants may be used in the present invention. For example, commercially available antioxidants for rubbers, plastic materials, and fats and oils are available.

Furthermore, when necessary, the photoconductive layer 13 may further comprise an ultraviolet absorbing agent to protect the photoconductive layer 13.

It is proper that the single-layered photoconductive layer 13 be in the range of 5 to 100 $\mu$m.

The electrophotographic photoconductor of the present invention may further comprise the protective layer 15, as illustrated in FIGS. 2 and 6.

The protective layer 15 comprises a resin as the main component.

Examples of the resin for use in the protective layer 15 are ABS resin, copolymer of olefin and vinyl monomer, chlorinated polyether, allyl resin, phenolic resin, polyacetal, polyamide, polyamideimide, polyacrylate, polyallyl sulfone, polybutylene, polybutylene terephthalate, polycarbonate, polyether sulfone, polyethylene, polyethylene terephthalate, polyimide, acrylic resin, polymethyl pentene, polypropylene, polyphenylene oxide, polysulfone, AS resin, AB resin, BS resin, polyurethane, polyvinyl chloride, polyvinylidene chloride, and epoxy resin.

To improve the wear resistance of the protective layer 15, fluoroplastics such as polytetrafluoroethylene and silicone resins, and those resins in which an inorganic material such as titanium oxide, tin oxide or potassium titanate is dispersed may be added to the protective layer 15.

The protective layer 15 can be provided by any of the conventional coating methods, and the thickness of the protective layer 15 is preferably in the range of about 0.5 to 10 $\mu$m.

Furthermore, the protective layer 15 can be prepared by vacuum thin film-forming method using conventional materials such as i-C and a-SiC.

In the photoconductor of the present invention, an undercoat layer (not shown) may be interposed between the photoconductive layer 13 (or 13') and the protective layer 15. The undercoat layer comprises as the main component a binder resin, such as polyamide, alcohol-soluble nylon resin, water-soluble polyvinyl butyral, polyvinyl butyral, and polyvinyl alcohol.

The undercoat layer can also be provided by any of the conventional coating methods, and the thickness of the undercoat layer is preferably in the range of about 0.05 to 2 $\mu$m.

In the electrophotographic photoconductor according to the present invention, an intermediate layer 17 may be interposed between the electroconductive support 11 and the photoconductive layer 13 as shown in FIG. 3. When the photoconductor comprises the photoconductive layer 13' of a laminated type, the intermediate layer 17 may be interposed between the electroconductive support 11 and the charge generation layer 21, as shown in FIG. 7.

The intermediate layer 17 comprises a resin as the main component. The photoconductive layer 13 is provided on the intermediate layer 17 by coating method using a solvent, so that it is desirable that the resin for use in the intermediate layer 17 have high resistance against general-purpose organic solvents.

Preferable examples of the resin for use in the intermediate layer 17 include water-soluble resins such as polyvinyl alcohol, casein and sodium polyacrylate; alcohol-soluble resins such as copolymer nylon and methoxymethylated nylon; and hardening resins with three-dimensional network such as polyurethane, melamine resin, alkyd-melamine resin and epoxy resin.

In order to prevent the occurrence of Moiré and reduce the residual potential, the intermediate layer 17 may further comprise finely-divided particles of metallic oxides such as titanium oxide, silica, alumina, zirconium oxide, tin oxide and indium oxide.

Similar to the photoconductive layer 13, the intermediate layer 17 can be provided on the electroconductive support 11 by coating method, using an appropriate solvent.

Further, the intermediate layer 17 for use in the present invention may be a metallic oxide layer prepared by the sol-gel processing using a coupling agent such as silane coupling agent, titanium coupling agent or chromium coupling agent.

Furthermore, to prepare the intermediate layer 17, $Al_2O_3$ may be deposited on the electroconductive support 11 by the anodizing process, or an organic material such as poly-para-xylylene (parylene), or an inorganic material such as SiO, $SnO_2$, $TiO_2$, ITO or $CeO_2$ may be deposited on the electroconductive support 11 by vacuum thin-film forming method.

It is preferable that the thickness of the intermediate layer 17 be 5 $\mu$m or less.

Other features of this invention will become apparent in the course of the following description of exemplary embodiments, which are given for illustration of the invention and are not intended to be limiting thereof.

EXAMPLE 1

<Fabrication of Electrophotographic Photoconductor No. 1>

[Formation of Intermediate Layer]

A mixture of the following components was dispersed to prepare a coating liquid for an intermediate layer:

| | Parts by Weight |
|---|---|
| Alcohol-soluble nylon (Trademark "CM8000", made by Toray Industries, Inc.) | 3 |
| Methanol | 70 |
| Butanol | 30 |

The thus prepared coating liquid was coated on the outer surface of an aluminum drum with a diameter of 80 mm and dried. Thus, an intermediate layer with a thickness of 0.3 $\mu$m was provided on the aluminum drum.

[Formation of Charge Generation Layer]

The following components were mixed to prepare a coating liquid for a charge generation layer:

| | Parts by Weight |
|---|---|
| Polyvinyl butyral (Trademark "XYHL", made by Union Carbide Japan K.K.) | 1 |
| Cyclohexanone | 200 |
| Methyl ethyl ketone | 100 |
| Azo pigment of the following formula: | 3 |

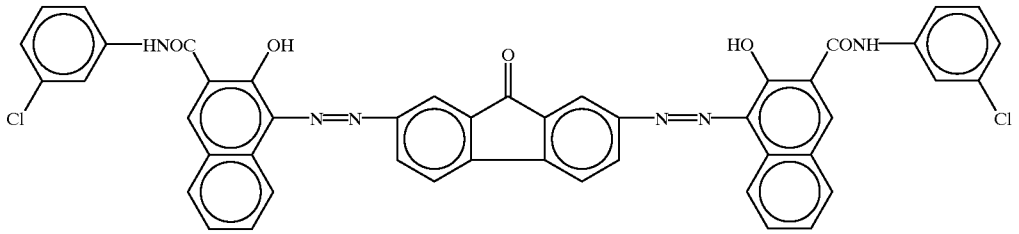

The thus obtained coating liquid was coated on the above prepared intermediate layer and dried, so that a charge generation layer with a thickness of 0.2 μm was provided on the intermediate layer.

[Formation of Charge Transport Layer]

The following components were mixed to prepare a coating liquid for a charge transport layer:

| | Parts by Weight |
|---|---|
| Polycarbonate (Trademark "Panlite K-1300", made by Teijin Chemicals Ltd.) | 10 |
| Methylene chloride | 200 |
| Charge transport material of the following formula: | 9 |

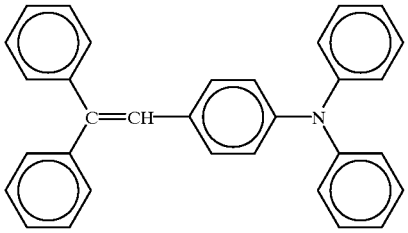

The thus prepared coating liquid was coated on the above prepared charge generation layer and dried, so that a charge transport layer with a thickness of 20 μm was provided on the charge generation layer.

Thus, an electrophotographic photoconductor No. 1 according to the present invention was fabricated.

The azo pigment used as the charge generation material was subjected to the measurement of X-ray diffraction spectrum using a commercially available measuring instrument (Trademark "RINT1100", made by Rigaku Corporation). The half-width of the peak at a Bragg angle of 26.5±0.8° was 3.3°.

EXAMPLE 2

The procedure for fabrication of the electrophotographic photoconductor No. 1 in Example 1 was repeated except that the azo pigment serving as the charge generation material used in the coating liquid for the charge generation layer in Example 1 was replaced by the following azo pigment:

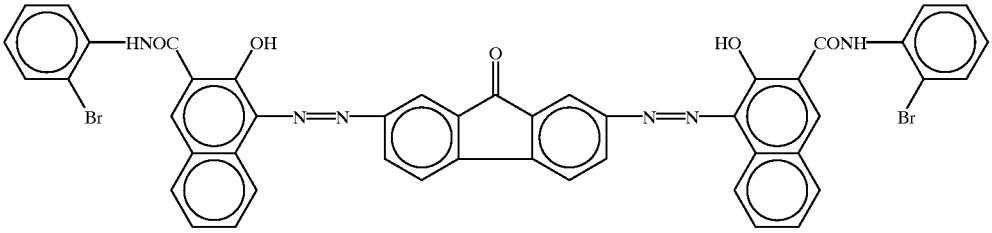

Thus, an electrophotographic photoconductor No. 2 according to the present invention was fabricated.

The azo pigment used as the charge generation material was subjected to the measurement of X-ray diffraction spectrum using a commercially available measuring instrument (Trademark "RINT1100", made by Rigaku Corporation). The half-width of the peak at a Bragg angle of 26.5±0.8° was 6.3°.

EXAMPLE 3

The procedure for fabrication of the electrophotographic photoconductor No. 1 in Example 1 was repeated except that the azo pigment serving as the charge generation material used in the coating liquid for the charge generation layer in Example 1 was replaced by the following azo pigment:

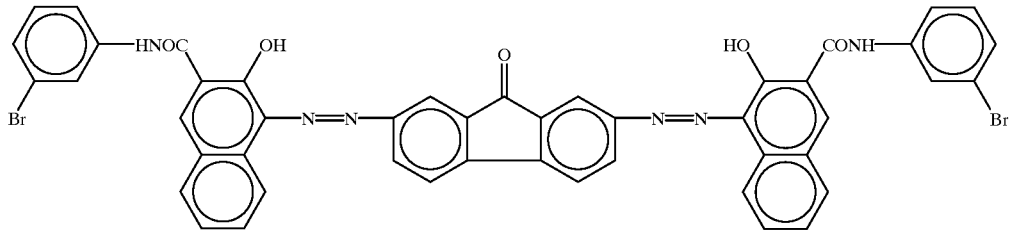

Thus, an electrophotographic photoconductor No. 3 according to the present invention was fabricated.

The azo pigment used as the charge generation material was subjected to the measurement of X-ray diffraction spectrum using a commercially available measuring instrument (Trademark "RINT1100", made by Rigaku Corporation). The half-width of the peak at a Bragg angle of 26.5±0.8° was 3.6°.

EXAMPLE 4

The procedure for fabrication of the electrophotographic photoconductor No. 1 in Example 1 was repeated except that the azo pigment serving as the charge generation material used in the coating liquid for the charge generation layer in Example 1 was replaced by the following azo pigment:

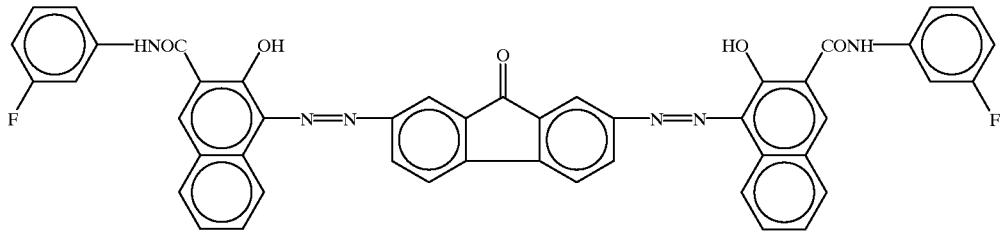

Thus, an electrophotographic photoconductor No. 4 according to the present invention was fabricated.

The azo pigment used as the charge generation material was subjected to the measurement of X-ray diffraction spectrum using a commercially available measuring instrument (Trademark "RINT1100", made by Rigaku Corporation). The half-width of the peak at a Bragg angle of 26.5±0.8° was 3.0°.

EXAMPLE 5

The procedure for fabrication of the electrophotographic photoconductor No. 1 in Example 1 was repeated except that the azo pigment serving as the charge generation material used in the coating liquid for the charge generation layer in Example 1 was replaced by the following azo pigment:

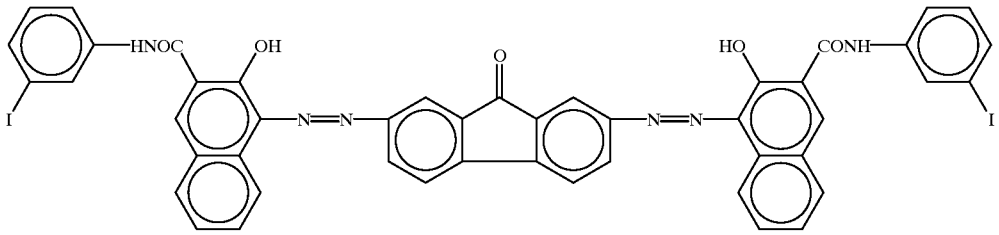

Thus, an electrophotographic photoconductor No. 5 according to the present invention was fabricated.

The azo pigment used as the charge generation material was subjected to the measurement of X-ray diffraction spectrum using a commercially available measuring instrument (Trademark "RINT1100", made by Rigaku Corporation). The half-width of the peak at a Bragg angle of 26.5±0.8° was 6.0°.

EXAMPLE 6

The procedure for fabrication of the electrophotographic photoconductor No. 1 in Example 1 was repeated except that the azo pigment serving as the charge generation material used in the coating liquid for the charge generation layer in Example 1 was replaced by the following azo pigment:

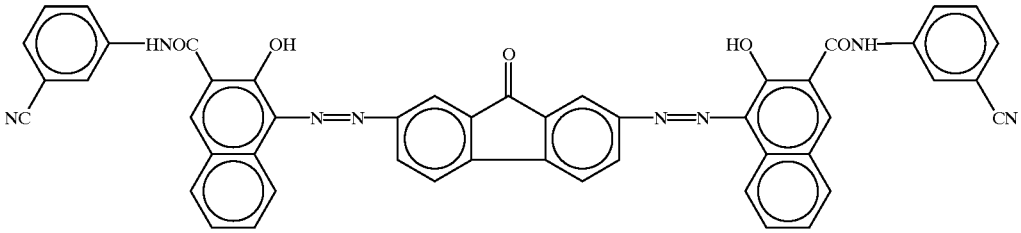

Thus, an electrophotographic photoconductor No. 6 according to the present invention was fabricated.

The azo pigment used as the charge generation material was subjected to the measurement of X-ray diffraction spectrum using a commercially available measuring instrument (Trademark "RINT1100", made by Rigaku Corporation). The half-width of the peak at a Bragg angle of 26.5±0.8° was 3.2°.

EXAMPLE 7

The procedure for fabrication of the electrophotographic photoconductor No. 1 in Example 1 was repeated except that the azo pigment serving as the charge generation material used in the coating liquid for the charge generation layer in Example 1 was replaced by the following azo pigment:

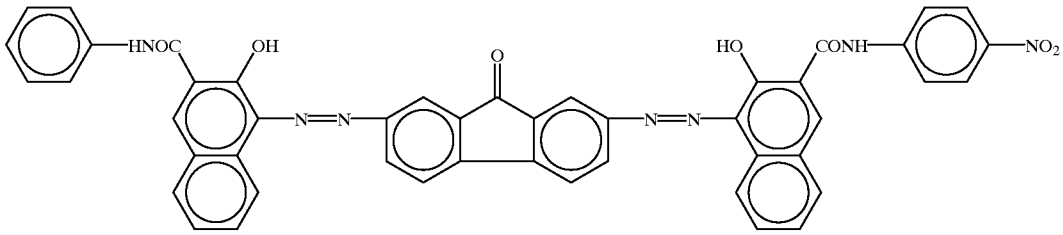

Thus, an electrophotographic photoconductor No. 7 according to the present invention was fabricated.

The azo pigment used as the charge generation material was subjected to the measurement of X-ray diffraction spectrum using a commercially available measuring instrument (Trademark "RINT1100", made by Rigaku Corporation). The half-width of the peak at a Bragg angle of 26.5±0.8° was 2.7°.

Comparative Example 1

The procedure for fabrication of the electrophotographic photoconductor No. 1 in Example 1 was repeated except that the azo pigment serving as the charge generation material used in the coating liquid for the charge generation layer in Example 1 was replaced by the following azo pigment:

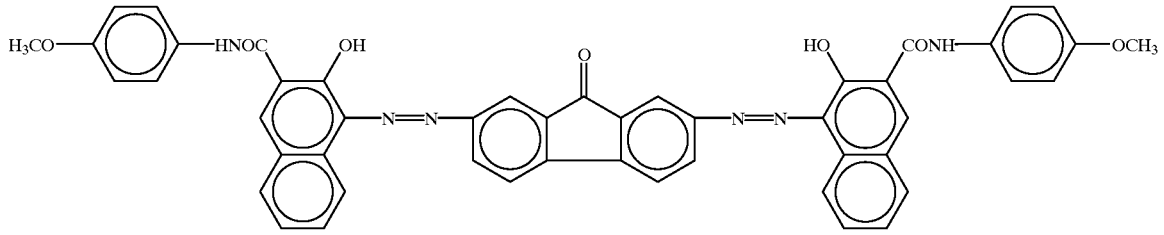

Thus, a comparative electrophotographic photoconductor No. 1 was fabricated.

The azo pigment used as the charge generation material was subjected to the measurement of X-ray diffraction spectrum using a commercially available measuring instrument (Trademark "RINT1100", made by Rigaku Corporation). The half-width of the peak at a Bragg angle of 26.5±0.8° was 1.8°.

Comparative Example 2

The procedure for fabrication of the electrophotographic photoconductor No. 1 in Example 1 was repeated except that the azo pigment serving as the charge generation material used in the coating liquid for the charge generation layer in Example 1 was replaced by the following azo pigment:

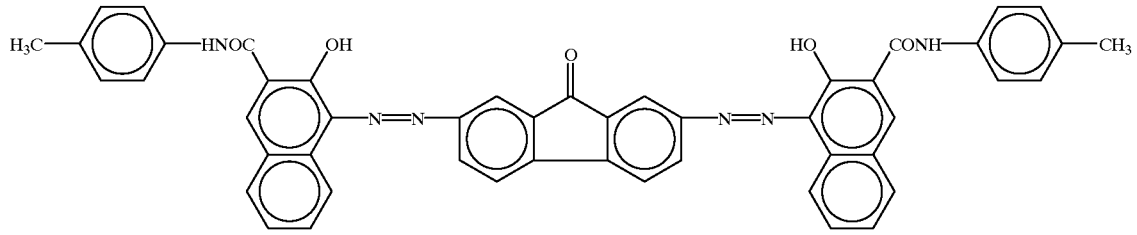

Thus, a comparative electrophotographic photoconductor No. 2 was fabricated.

The azo pigment used as the charge generation material was subjected to the measurement of X-ray diffraction spectrum using a commercially available measuring instrument (Trademark "RINT1100", made by Rigaku Corporation). The half-width of the peak at a Bragg angle of 26.5±0.8° was 0.8°.

Comparative Example 3

The procedure for fabrication of the electrophotographic photoconductor No. 1 in Example 1 was repeated except that the azo pigment serving as the charge generation material used in the coating liquid for the charge generation layer in Example 1 was replaced by the following azo pigment:

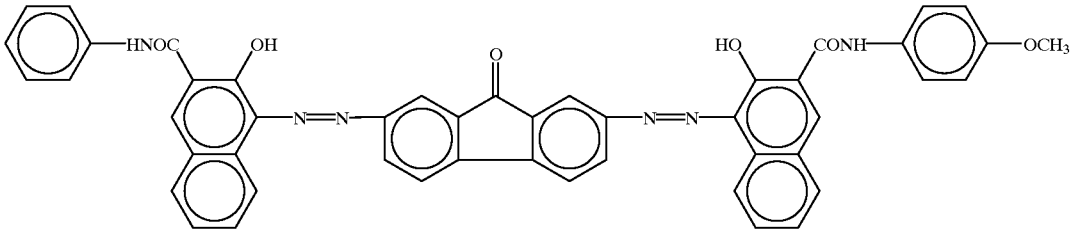

Thus, a comparative electrophotographic photoconductor No. 3 was fabricated.

The azo pigment used as the charge generation material was subjected to the measurement of X-ray diffraction spectrum using a commercially available measuring instrument (Trademark "RINT1100", made by Rigaku Corporation). The half-width of the peak at a Bragg angle of 26.5±0.8° was 1.1°.

Comparative Example 4

The procedure for fabrication of the electrophotographic photoconductor No. 1 in Example 1 was repeated except that the azo pigment serving as the charge generation material used in the coating liquid for the charge generation layer in Example 1 was replaced by the following azo pigment:

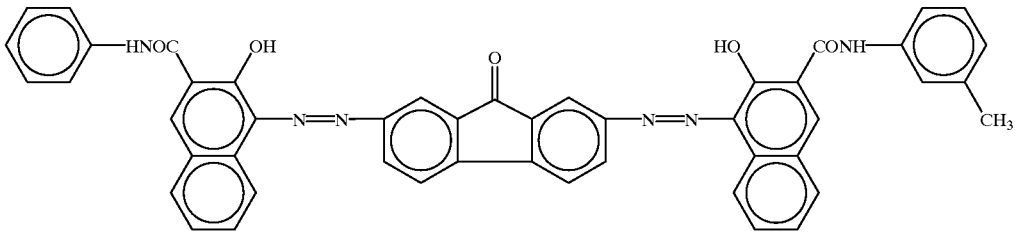

Thus, a comparative electrophotographic photoconductor No. 4 was fabricated.

The azo pigment used as the charge generation material was subjected to the measurement of X-ray diffraction spectrum using a commercially available measuring instrument (Trademark "RINT1100", made by Rigaku Corporation). The half-width of the peak at a Bragg angle of 26.5±0.8° was 1.5°.

Each of the above fabricated electrophotographic photoconductors No. 1 to No. 7 according to the present invention and comparative electrophotographic photoconductors No. 1 to No. 4 was charged negatively in the dark under application of −5.8 kv of corona charge for 20 seconds, using the electrophotographic properties testing apparatus disclosed in Japanese Laid-Open Patent Application 60-100167. Then, each photoconductor was allowed to stand in the dark for 20 seconds without the application of any charge thereto, and the surface potential (V) was measured after dark decay.

Each photoconductor was then illuminated by a light beam with a wavelength of 580±10 nm and a light volume of 2.0 $\mu$W/cm$^2$, and the exposure $E_{1/2}$ ($\mu$J/cm$^2$) required to reduce the above-mentioned surface potential (V) to ½ the surface potential (V) was measured.

The results are shown in TABLE 1.

Furthermore, each of the photoconductors fabricated in Examples 1 and 2 and Comparative Examples 1 and 4 was incorporated in a commercially available copying machine (Trademark "SPIRIO 2750", made by Ricoh Company, Ltd.), and a running test was conducted by continuously making 50,000 copies. In the running test, the image obtained on the 10th copy paper and that on the 50,000th copy paper were evaluated.

The results are also shown in TABLE 1.

TABLE 1

| | Half-width of Peak at 26.5 ± 0.8° in X-ray Diffraction Spectrum of Azo Pigment | Photo-sensi-tivity ($E_{1/2}$) [$\mu$J/cm$^2$] | Image Evaluation in Running Test | |
|---|---|---|---|---|
| | | | Image on 10th copy paper | Image on 50,000th copy paper |
| Ex. 1 | 3.3 | 0.18 | Excellent | Excellent |
| Ex. 2 | 6.3 | 0.24 | Excellent | Excellent |
| Ex. 3 | 3.6 | 0.16 | — | — |
| Ex. 4 | 3.0 | 0.20 | — | — |
| Ex. 5 | 6.0 | 0.21 | — | — |
| Ex. 6 | 3.2 | 0.25 | — | — |
| Ex. 7 | 2.7 | 0.32 | — | — |
| Comp. Ex. 1 | 1.8 | 1.21 | Slight toner deposition on background | Striking toner deposition on background |
| Comp. Ex. 2 | 0.8 | 1.50 | — | — |
| Comp. Ex. 3 | 1.1 | 0.68 | — | — |
| Comp. | 1.5 | 0.53 | Slight | Striking |

TABLE 1-continued

| | Half-width of Peak at 26.5 ± 0.8° in X-ray Diffraction Spectrum of Azo Pigment | Photo-sensi-tivity ($E_{1/2}$) [$\mu J/cm^2$] | Image Evaluation in Running Test | |
|---|---|---|---|---|
| | | | Image on 10th copy paper | Image on 50,000th copy paper |
| Ex. 4 | | | toner deposition on background | toner deposition on background |

EXAMPLE 8

The procedure for fabrication of the electrophotographic photoconductor No. 1 in Example 1 was repeated except that the formulation for the coating liquid of the charge transport layer in Example 1 was changed to the following formulation:

Thus, an electrophotographic photoconductor No. 8 according to the present invention was fabricated.

EXAMPLE 9

The procedure for fabrication of the electrophotographic photoconductor No. 8 in Example 9 was repeated except that the high-molecular weight charge transport material for use in the formulation for the charge transport layer coating liquid in Example 8 was replaced by the following high-molecular weight charge transport material:

| | Parts by Weight |
|---|---|
| Methylene chloride | 200 |
| Charge transport material of the following formula: | 2 |

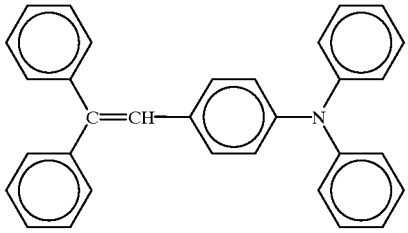

High-molecular weight charge transport material comprising a repeat unit of the following formula: 10

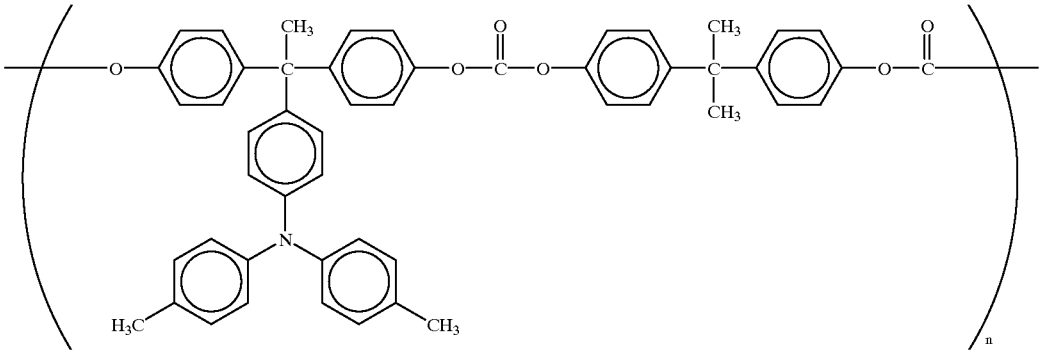

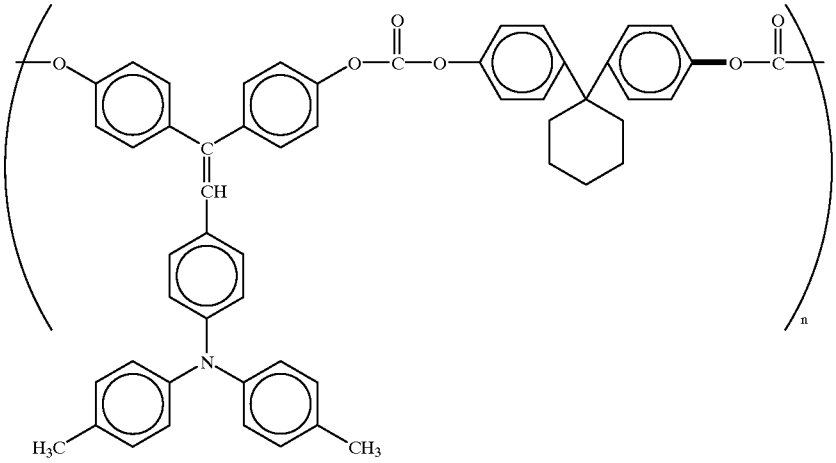

Thus, an electrophotographic photoconductor No. 9 according to the present invention was fabricated.

EXAMPLE 10

The procedure for fabrication of the electrophotographic photoconductor No. 8 in Example 8 was repeated except that the high-molecular weight charge transport material for use in the formulation for the charge transport layer coating liquid in Example 8 was replaced by the following high-molecular weight charge transport material:

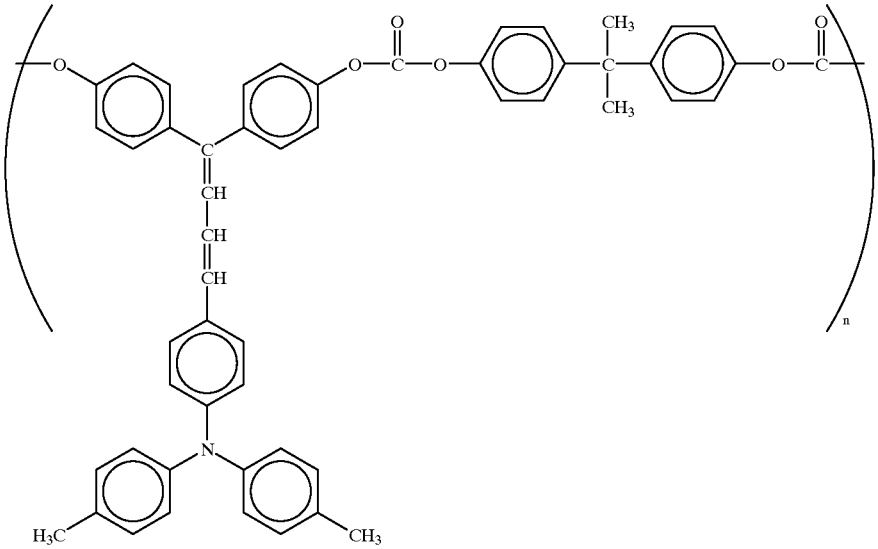

Thus, an electrophotographic photoconductor No. 10 according to the present invention was fabricated.

EXAMPLE 11

The procedure for fabrication of the electrophotographic photoconductor No. 8 in Example 8 was repeated except that the high-molecular weight charge transport material for use in the formulation for the charge transport layer coating liquid in Example 8 was replaced by the following high-molecular weight charge transport material:

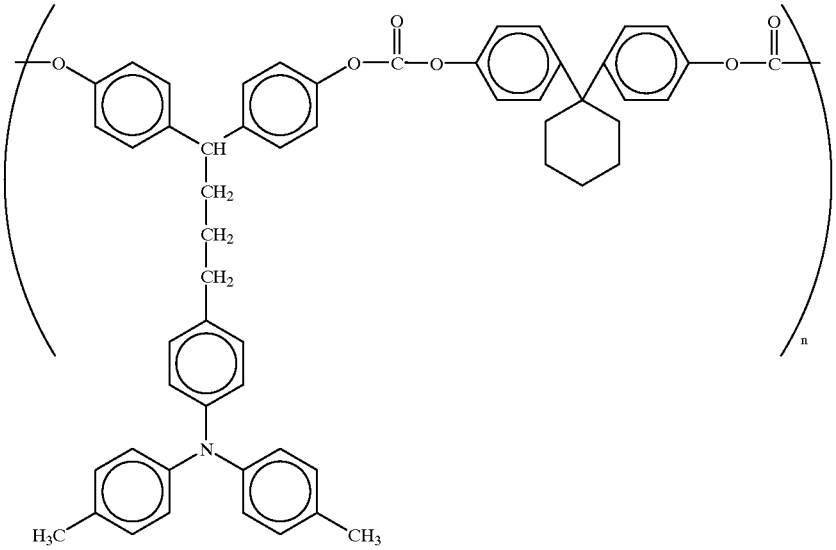

Thus, an electrophotographic photoconductor No. 11 according to the present invention was fabricated.

EXAMPLE 12

The procedure for fabrication of the electrophotographic photoconductor No. 8 in Example 8 was repeated except that the high-molecular weight charge transport material for use in the formulation for the charge transport layer coating liquid in Example 8 was replaced by the following high-molecular weight charge transport material:

Thus, an electrophotographic photoconductor No. 12 according to the present invention was fabricated.

EXAMPLE 13

The procedure for fabrication of the electrophotographic photoconductor No. 8 in Example 8 was repeated except that the high-molecular weight charge transport material for use in the formulation for the charge transport layer coating liquid in Example 3 was replaced by the following high-molecular weight charge transport material:

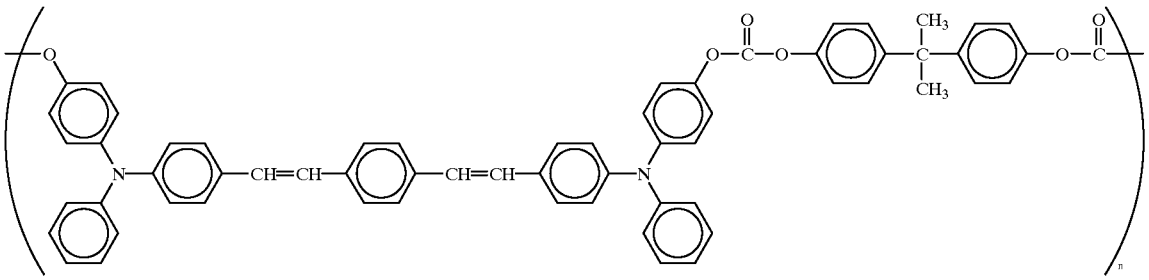

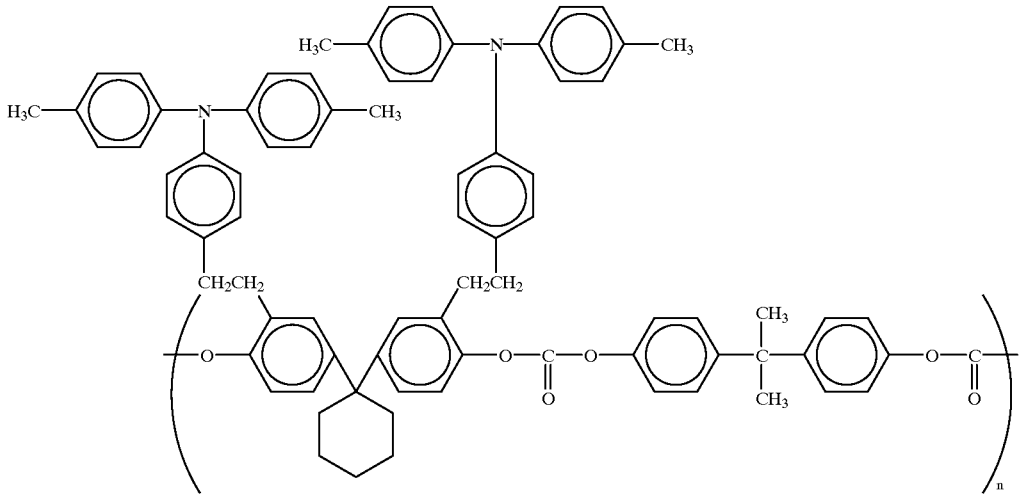

Thus, an electrophotographic photoconductor No. 13 according to the present invention was fabricated.

EXAMPLE 14

The procedure for fabrication of the electrophotographic photoconductor No. 8 in Example 8 was repeated except that the high-molecular weight charge transport material for use in the formulation for the charge transport layer coating liquid in Example 8 was replaced by the following high-molecular weight charge transport material:

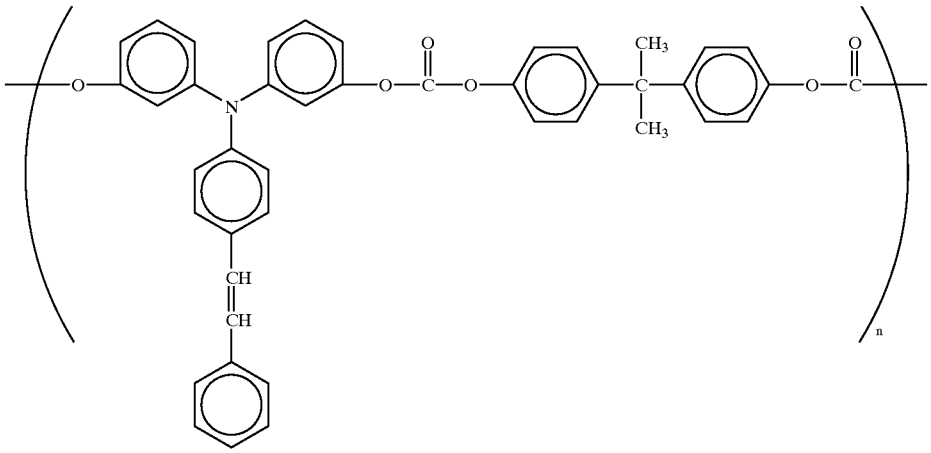

Thus, an electrophotographic photoconductor No. 14 according to the present invention was fabricated.

EXAMPLE 15

The procedure for fabrication of the electrophotographic photoconductor No. 8 in Example 8 was repeated except that the high-molecular weight charge transport material for use in the formulation for the charge transport layer coating liquid in Example 8 was replaced by the following high-molecular weight charge transport material:

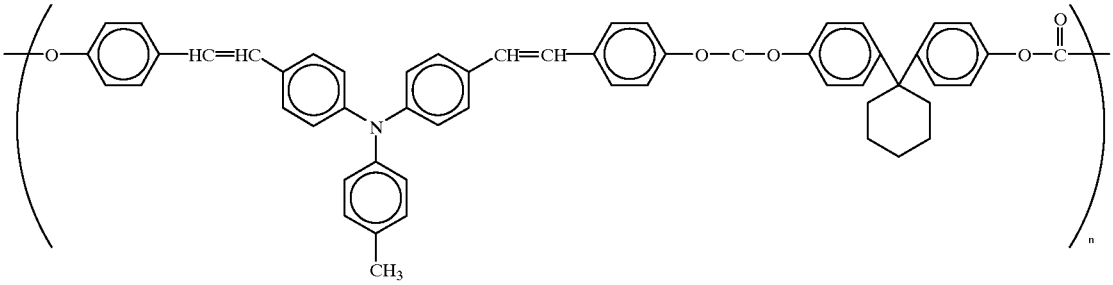

Thus, an electrophotographic photoconductor No. 15 according to the present invention was fabricated.

EXAMPLE 16

The procedure for fabrication of the electrophotographic photoconductor No. 8 in Example 8 was repeated except that the high-molecular weight charge transport material for use in the formulation for the charge transport layer coating liquid in Example 8 was replaced by the following high-molecular weight charge transport material:

Thus, an electrophotographic photoconductor No. 16 according to the present invention was fabricated.

EXAMPLE 17

The procedure for fabrication of the electrophotographic photoconductor No. 8 in Example 8 was repeated except that the high-molecular weight charge transport material for use in the formulation for the charge transport layer coating liquid in Example 8 was replaced by the following high-molecular weight charge transport material:

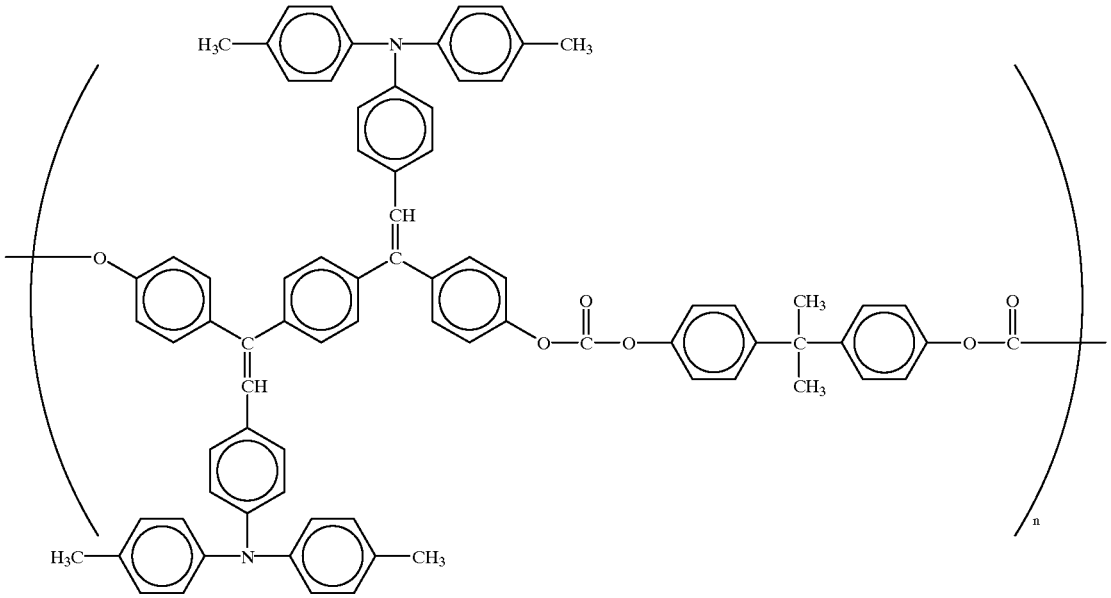

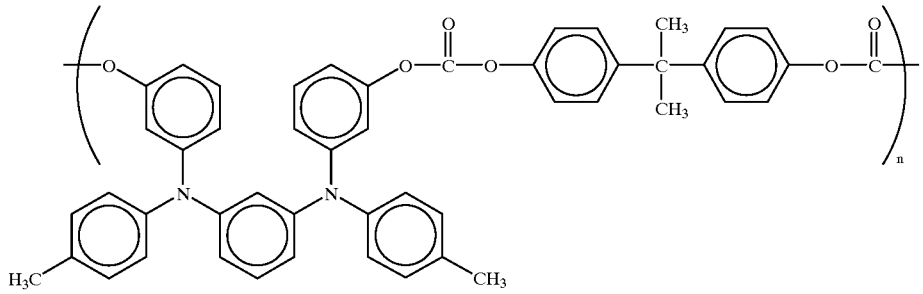

Thus, an electrophotographic photoconductor No. 17 according to the present invention was fabricated.

Each of the photoconductors fabricated in Examples 1 and 8 through 17 was incorporated in a commercially available copying machine (Trademark "SPIRIO 2750", made by Ricoh Company, Ltd.), and a running test was conducted by continuously making 70,000 copies. After the completion of the running test, a decrease ($\mu$m) in thickness of the charge transport layer was measured.

The results are shown in TABLE 2.

TABLE 2

| | Decrease in Thickness of CTL ($\mu$m) |
|---|---|
| Ex. 1 | 3.5 |
| Ex. 8 | 2.3 |
| Ex. 9 | 2.4 |
| Ex. 10 | 2.1 |
| Ex. 11 | 2.2 |
| Ex. 12 | 2.5 |
| Ex. 13 | 2.1 |
| Ex. 14 | 2.4 |
| Ex. 15 | 2.3 |
| Ex. 16 | 2.4 |
| Ex. 17 | 2.1 |

As previously explained, there can be provided a photoconductor with remarkably high photosensitivity. When the electrophotographic process is carried out for image formation using the photoconductor according to the present invention, the toner deposition on the background can be minimized in the positive-positive development and the decrease of image density can be minimized in the negative-positive development after the process is repeated for an extended period of time. This is because the increase of residual potential of the photoconductor can be effectively prevented during the repeated operations.

In addition, the photoconductive layer can be prevented from being scraped off while the electrophotographic process is repeated for a long time. The high abrasion resistance can be thus imparted to the photoconductor, and therefore, excellent image quality can be obtained without abnormal images such as black stripes.

Japanese Patent Application No. 09-063956 filed Mar. 4, 1997, and Japanese Patent Application filed Mar. 3, 1998 are hereby incorporated by reference.

What is claimed is:

1. An electrophotographic photoconductor comprising an electroconductive support, and a photoconductive layer formed thereon comprising a charge generation material which comprises an azo pigment of formula (1):

(1)

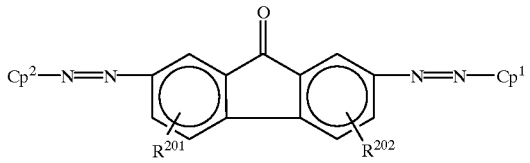

wherein $R^{201}$ and $R^{202}$, which may be the same or different, are each a hydrogen atom, a halogen atom, an alkyl group having 1 to 4 carbon atoms, an alkoxyl group having 1 to 4 carbon atoms or cyano group; and $Cp^1$ and $Cp^2$, which are different, are each a coupler radical represented by formula (2):

(2)

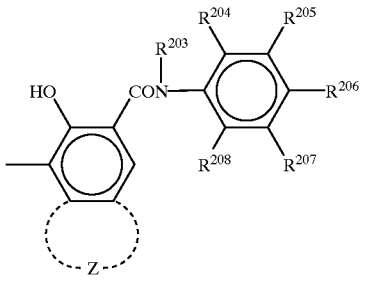

in which $R^{203}$ is a hydrogen atom, an alkyl group having 1 to 4 carbon atoms or an aryl group; $R^{204}$, $R^{205}$, $R^{206}$, $R^{207}$ and $R^{208}$ are each a hydrogen atom, nitro group, cyano group, a halogen atom, trifluoromethyl group, an alkyl group having 1 to 4 carbon atoms, an alkoxyl group having 1 to 4 carbon atoms, a dialkylamino group or hydroxyl group; and Z is an atomic group which constitutes a substituted or unsubstituted aromatic hydrocarbon ring, or a substituted or unsubstituted aromatic heterocyclic ring, said azo pigment showing a diffraction peak at a Bragg angle of 26.5±0.8° in the X-ray diffraction spectrum with respect to Cu—K$\alpha$ ray, and a half-width of 2° or more in said peak at the Bragg angle of 26.5±0.8°.

2. The electrophotographic photoconductor as claimed in claim 1, wherein said coupler radicals represented by $Cp^1$ and $Cp^2$ in formula (1) are different.

3. The electrophotographic photoconductor as claimed in claim 1, wherein said photoconductive layer comprises a charge generation layer comprising said azo pigment and a charge transport layer, said charge generation layer and said charge transport layer being successively overlaid on said electroconductive support.

4. The electrophotographic photoconductor as claimed in claim 3, therein said charge transport layer comprises at least one polycarbonate compound comprising a triarylamine structure on the main chain and/or side chain thereof.

5. The electrophotographic photoconductor as claimed in claim 4, wherein said polycarbonate compound is represented by formula (3):

(3)

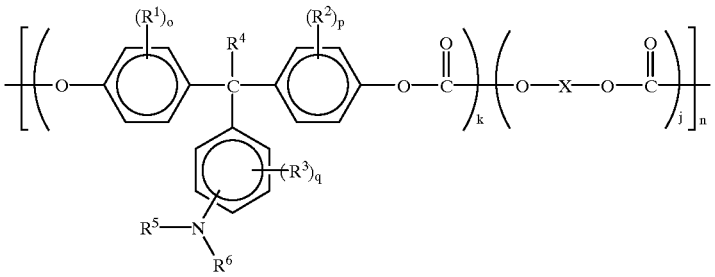

wherein $R^1$, $R^2$ and $R^3$ are each independently an alkyl group which may have a substituent or a halogen atom; $R^4$ is hydrogen atom or an alkyl group which may have a substituent; $R^5$ and $R^6$ are each independently an aryl group which may have a substituent; o, p and q are each independently an integer of 0 to 4; $0.1 \leqq k \leqq 1$; $0 \leqq j \leqq 0.9$; n is an integer of 5 to 5,000; and X is a bivalent aliphatic group, bivalent cyclic aliphatic group or a bivalent group represented by formula (3-a):

(3-a)

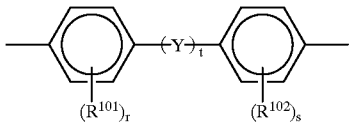

in which $R^{101}$ and $R^{102}$ may be the same or different, and are each independently an alkyl group which may have a substituent, an aryl group which may have a substituent or a halogen atom; r and s are each independently an integer of 0 to 4; t is an integer of 0 or 1, and when t=1, Y is a straight-chain, branched or cyclic alkylene group having 1 to 12 carbon atoms, —O—, —S—, —SO—, —$SO_2$—, —CO—, 13 CO—O—Z—O—CO— in which Z is a bivalent aliphatic group, or (3-b)

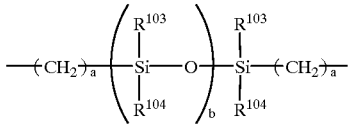

in which a is an integer of 1 to 20; b is an integer of 1 to 2,000; and $R^{103}$ and $R^{104}$, which may be the same or different, are each independently an alkyl group which may have a substituent or an aryl group which may have a substituent.

6. The electrophotographic photoconductor as claimed in claim 4, wherein said polycarbonate compound is represented by formula (4);

(4)

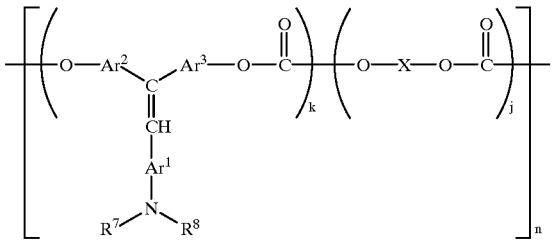

wherein $R^7$ and $R^8$ are each independently an aryl group which may have a substituent; $Ar^1$, $Ar^2$ and $Ar^3$, which may be the same or different, are each independently an arylene group; $0.1 \leqq k \leqq 1$; $0 \leqq j \leqq 0.9$; n is an integer of 5 to 5,000; and X is a bivalent aliphatic group, bivalent cyclic aliphatic group or a bivalent group represented by formula (3-a):

(3-a)

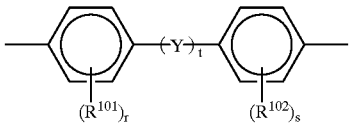

in which $R^{101}$ and $R^{102}$ may be the same or different, and are each independently an alkyl group which may have a substituent, an aryl group which may have a substituent or a halogen atom; r and s are each independently an integer of 0 to 4; t is an integer of 0 or 1, and when t=1, Y is a straight-chain, branched or cyclic alkylene group having 1 to 12 carbon atoms, —O—, —S—, —SO—, —$SO_2$—, —CO—, —CO—O—Z—O—CO— in which Z is a bivalent aliphatic group, or (3-b)

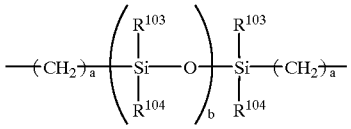

in which a is an integer of 1 to 20; b is an integer of 1 to 2,000; and $R^{103}$ and $R^{104}$, which may be the same or different, are each independently an alkyl group which may have a substituent or an aryl group which may have a substituent.

7. The electrophotographic photoconductor as claimed in claim 4, wherein said polycarbonate compound is represented by formula (5):

(5)

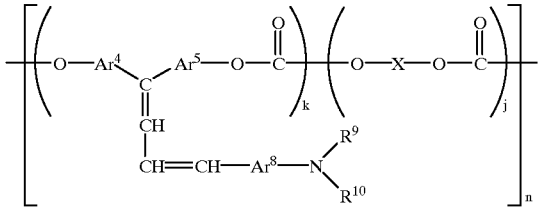

wherein $R^9$ and $R^{10}$ are each independently an aryl group which may have a substituent; $Ar^4$, $Ar^5$ and $Ar^6$, which may be the same or different, are each independently an arylene group; $0.1 \leqq k \leqq 1$; $0 \leqq j \leqq 0.9$; n is an integer of 5 to 5,000; and X is a bivalent aliphatic group, bivalent cyclic aliphatic group or a bivalent group represented by formula (3-a):

(3-a)

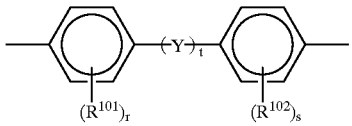

in which $R^{101}$ and $R^{102}$ may be the same or different, and are each independently an alkyl group which may have a substituent, an aryl group which may have a substituent or a halogen atom; r and s are each independently an integer of 0 to 4; t is an integer of 0 or 1, and when t=1, Y is a straight-chain, branched or cyclic alkylene group having 1 to 12 carbon atoms, —O—, —S—, —SO—, —$SO_2$—, —CO—, —CO—O—Z—O—CO— in which Z is a bivalent aliphatic group, or (3-b)

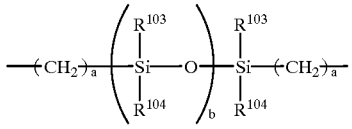

in which a is an integer of 1 to 20; b is an integer of 1 to 2,000; and $R^{103}$ and $R^{104}$, which may be the same or different, are each independently an alkyl group which may have a substituent or an aryl group which may have a substituent.

8. The electrophotographic photoconductor as claimed in claim 4, wherein said polycarbonate compound is represented by formula (6):

(6)

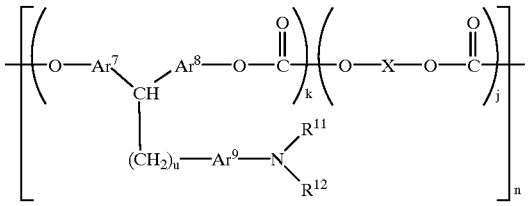

wherein $R^{11}$ and $R^{12}$ are each independently an aryl group which may have a substituent; $Ar^7$, $Ar^8$ and $Ar^9$, which may be the same or different, are each independently an arylene group; u is an integer of 1 to 5; $0.1 \leqq k \leqq 1$; $0 \leqq j \leqq 0.9$; n is an integer of 5 to 5,000; and X is a bivalent aliphatic group, bivalent cyclic aliphatic group or a bivalent group represented by formula (3-a):

(3-a)

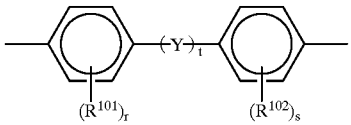

in which $R^{101}$ and $R^{102}$ may be the same or different, and are each independently an alkyl group which may have a substituent, an aryl group which may have a substituent or a halogen atom; r and s are each independently an integer of 0 to 4; t is an integer of 0 or 1, and when t=1, Y is a straight-chain, branched or cyclic alkylene group having 1 to 12 carbon atoms, —O—, —S—, —SO—, —$SO_2$—, —CO—, —CO—O—Z—O—CO— in which Z is a bivalent aliphatic group, or (3-b)

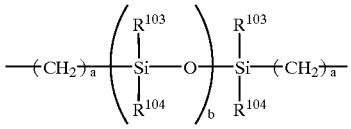

in which a is an integer of 1 to 20; b is an integer of 1 to 2,000; and $R^{103}$ and $R^{104}$, which may be the same or different, are each independently an alkyl group which may have a substituent or an aryl group which may have a substituent.

9. The electrophotographic photoconductor as claimed in claim 4, wherein said polycarbonate compound is represented by formula (7);

(7)

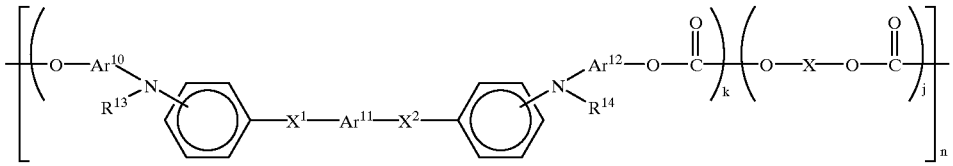

wherein $R^{13}$ and $R^{14}$ are each independently an aryl group which may have a substituent; $Ar^{10}$, $Ar^{11}$ and $Ar^{12}$, which may be the same or different, are each independently an arylene group; $X^1$ and $X^2$ are each independently ethylene group which may have a substituent or vinylene group which may have a substituent; $0.1 \leqq k \leqq 1$; $0 \leqq j \leqq 0.9$; n is an integer of 5 to 5,000; and X is a bivalent aliphatic group, bivalent cyclic aliphatic group or a bivalent group represented by formula (3-a):

(3-a)

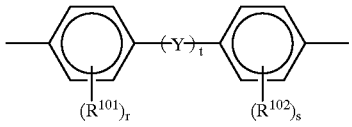

in which $R^{101}$ and $R^{102}$ may be the same or different, and are each independently an alkyl group which may have a substituent, an aryl group which may have a substituent or a halogen atom; r and s are each independently an integer of 0 to 4; t is an integer of 0 or 1, and when t=1, Y is a straight-chain, branched or cyclic alkylene group having 1 to 12 carbon atoms, —O—, —S—, —SO—, —$SO_2$—, —CO—, —CO—O—Z—O—CO— in which Z is a bivalent aliphatic group, or (3-b)

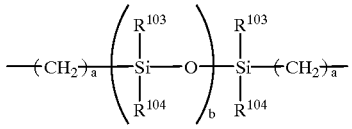

in which a is an integer of 1 to 20; b is an integer of 1 to 2,000; and $R^{103}$ and $R^{104}$, which may be the same or different, are each independently an alkyl group which may have a substituent or an aryl group which may have a substituent.

10. The electrophotographic photoconductor as claimed in claim 4, wherein said polycarbonate compound is represented by formula (8):

(8)

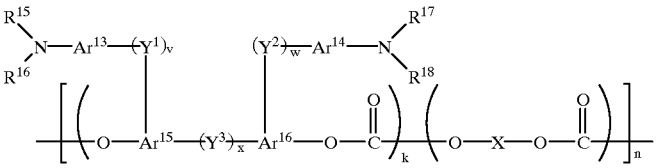

wherein $R^{15}$, $R^{16}$, $R^{17}$ and $R^{18}$ are each independently an aryl group which may have a substituent; $Ar^{13}$, $Ar^{14}$, $Ar^{15}$ and $Ar^{16}$, which may be the same or different, are each independently an arylene group; v, w and x are each independently an integer of 0 or 1, and when v, w and x are an integer of 1, $Y^1$, $Y^2$ and $Y^3$, which may be the same or different, are each independently an alkylene group which may have a substituent, a cycloalkylene group which may have a substituent, an alkylene ether group which may have a substituent, oxygen atom, sulfur atom, or vinylene group; $0.1 \leqq k \leqq 1$; $0 \leqq j \leqq 0.9$; n is an integer of 5 to 5,000; and X is a bivalent aliphatic group, bivalent cyclic aliphatic group or a bivalent group represented by formula (3-a):

(3-a)

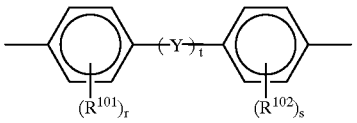

in which $R^{101}$ and $R^{102}$ may be the same or different, and are each independently an alkyl group which may have a substituent, an aryl group which may have a substituent or a halogen atom; r and s are each independently an integer of 0 to 4; t is an integer of 0 or 1, and when t=1, Y is a straight-chain, branched or cyclic alkylene group having 1 to 12 carbon atoms, —O—, —S—, —SO—, —$SO_2$—, —CO—, —CO—O—Z—O—CO— in which Z is a bivalent aliphatic group, or (3-b)

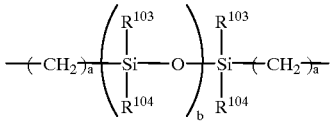

in which a is an integer of 1 to 20; b is an integer of 1 to 2,000; and $R^{103}$ and $R^{104}$, which may be the same or different, are each independently an alkyl group which may have a substituent or an aryl group which may have a substituent.

11. The electrophotographic photoconductor as claimed in claim 4, wherein said polycarbonate compound is represented by formula (9):

(9)

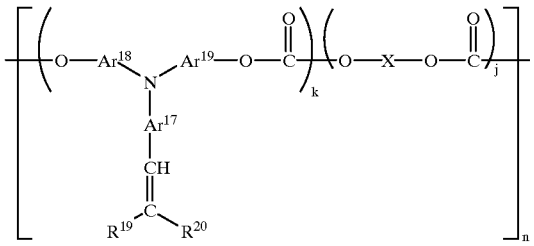

wherein $R^{19}$ and $R^{20}$ are each independently a hydrogen atom, or an aryl group which may have a substituent, and $R^{19}$ and $R^{20}$ may form a ring in combination; $Ar^{17}$, $Ar^{18}$ and $Ar^{19}$, which may be the same or different, are each independently an arylene group; $0.1 \leqq k \leqq 1$; $0 \leqq j \leqq 0.9$; n is an integer of 5 to 5,000; and X is a bivalent aliphatic group, bivalent cyclic aliphatic group or a bivalent group represented by formula (3-a):

(3-a)

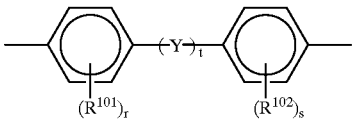

in which $R^{101}$ and $R^{102}$ may be the same or different, and are each independently an alkyl group which may have a substituent, an aryl group which may have a substituent or a halogen atom; r and s are each independently an integer of 0 to 4; t is an integer of 0 or 1, and when t=1, Y is a straight-chain, branched or cyclic alkylene group having 1 to 12 carbon atoms, —O—, —S—, —SO—, —$SO_2$—, —CO—, —CO—O—Z—O—CO— in which Z is a bivalent aliphatic group, or (3-b)

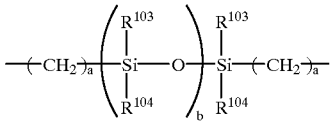

in which a is an integer of 1 to 20; b is an integer of 1 to 2,000; and $R^{103}$ and $R^{104}$, which may be the same or different, are each independently an alkyl group which may have a substituent or an aryl group which may have a substituent.

12. The electrophotographic photoconductor as claimed in claim 4, wherein said polycarbonate compound is represented by formula (10):

(10)

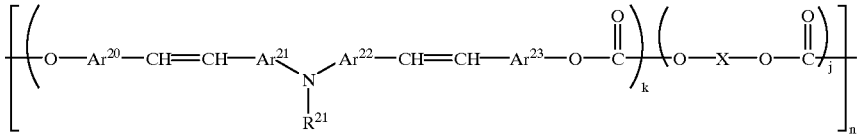

wherein $R^{21}$ is an aryl group which may have a substituent; $Ar^{20}$, $Ar^{21}$, $Ar^{22}$ and $Ar^{23}$, which may be the same or different, are each independently an arylene group; $0.1 \leqq k \leqq 1$; $0 \leqq j \leqq 0.9$; n is an integer of 5 to 5,000; and X is a bivalent aliphatic group, bivalent cyclic aliphatic group or a bivalent group represented by formula (3-a):

(3-a)

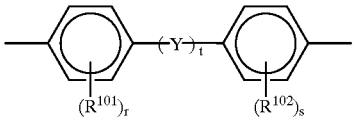

in which $R^{101}$ and $R^{102}$ may be the same or different, and are each independently an alkyl group which may have a substituent, an aryl group which may have a substituent or a halogen atom; r and s are each independently an integer of 0 to 4, t is an integer of 0 or 1, and when t=1, Y is a straight-chain, branched or cyclic alkylene group having 1 to 12 carbon atoms, —O—, —S—, —SO—, —$SO_2$—, —CO—, —CO—O—Z—O—CO— in which Z is a bivalent aliphatic group, or (3-b)

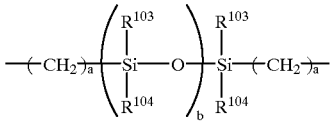

in which a is an integer of 1 to 20; b is an integer of 1 to 2,000; and $R^{103}$ and $R^{104}$, which may be the same or different, are each independently an alkyl group which may have a substituent or an aryl group which may have a substituent.

13. The electrophotographic photoconductor as claimed in claim 4, wherein said polycarbonate compound is represented by formula (11):

(11)

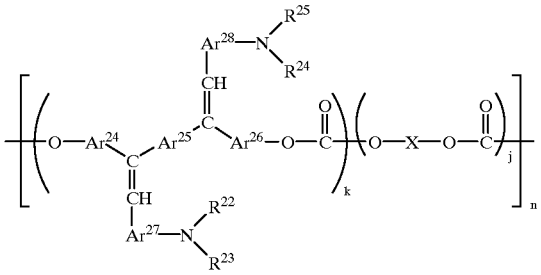

wherein $R^{22}$, $R^{23}$, $R^{24}$ and $R^{25}$ are each independently an aryl group which may have a substituent; $Ar^{24}$, $Ar^{25}$, $Ar^{26}$, $Ar^{27}$ and $Ar^{28}$, which may be the same or different, are each independently an arylene group; $0.1 \leqq k \leqq 1$; $0 \leqq j \leqq 0.9$; n is an integer of 5 to 5,000; and X is a bivalent aliphatic group, bivalent cyclic aliphatic group or a bivalent group represented by formula (3-a):

(3-a)

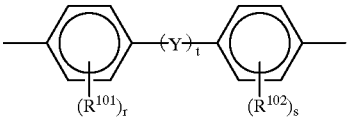

in which $R^{101}$ and $R^{102}$ may be the same or different, and are each independently an alkyl group which may have a substituent, an aryl group which may have a substituent or a halogen atom; r and s are each independently an integer of 0 to 4; t is an integer of 0 or 1, and when t=1, Y is a straight-chain, branched or cyclic alkylene group having 1 to 12 carbon atoms, —O—, —S—, —SO—, —$SO_2$—, —CO—, —CO—O—Z—O—CO— in which Z is a bivalent aliphatic group, or (3-b)

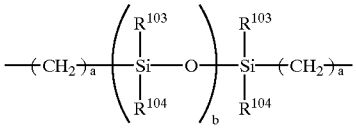

in which a is an integer of 1 to 20; b is an integer of 1 to 2,000; and $R^{103}$ and $R^{104}$, which may be the same or different, are each independently an alkyl group which may have a substituent or an aryl group which may have a substituent.

14. The electrophotographic photoconductor as claimed in claim 4, wherein said polycarbonate compound is represented by formula (12):

(12)

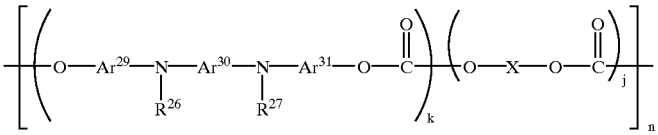

wherein $R^{26}$ and $R^{27}$ are each independently an aryl group which may have a substituent; $Ar^{29}$, $Ar^{30}$ and $Ar^{31}$, which may be the same or different, are each independently an arylene group; $0.1 \leqq k \leqq 1$; $0 \leqq j \leqq 0.9$; n is an integer of 5 to 5,000; and X is a bivalent aliphatic group, bivalent cyclic aliphatic group or a bivalent group represented by formula (3-a):

(3-a)

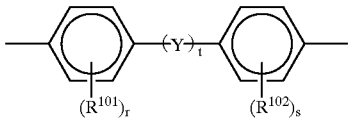

in which $R^{101}$ and $R^{102}$ may be the same or different, and are each independently an alkyl group which may have a substituent, an aryl group which may have a substituent or a halogen atom; r and s are each independently an integer of 0 to 4; t is an integer of 0 or 1, and when t=1, Y is a straight-chain, branched or cyclic alkylene group having 1 to 12 carbon atoms, —O—, —S—, —SO—, —$SO_2$—, —CO—, —CO—O—Z—O—CO— in which Z is a bivalent aliphatic group, or (3-b)

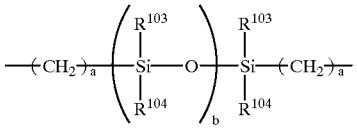

in which a is an integer of 1 to 20; b is an integer of 1 to 2,000; and $R^{103}$ and $R^{104}$, which may be the same or different, are each independently an alkyl group which may have a substituent or an aryl group which may have a substituent.

* * * * *

UNITED STATES PATENT AND TRADEMARK OFFICE

CERTIFICATE OF CORRECTION

PATENT NO. : 6,087,055
DATED : July 11, 2000
INVENTOR(S) : Tatsuya Niimi

It is certified that error appears in the above-identified patent and that said Letters Patent is hereby corrected as shown below:

Column 4,
Line 40, "show another examples" should read -- show other examples --.

Column 5,
Line 2, "the photocarriors." should read -- the photocarriers. --.

Column 6,
Line 24, "also pigment" should read -- azo pigment --;
Line 50, "carriers be extremely" should read -- carriers is extremely --.

Column 11,
Line 58, "group (—$OR^{108}$") in which $R^{109}$ is" should read -- group (—$OR^{105}$) in which $R^{105}$ is --.

Column 13,
Line 63 "wherein w is" should read -- wherein W is --.

Column 20,
Lines 40-41, "represented by $R^{18}$ to $R^{19}$." should read -- represented by $R^{15}$ to $R^{18}$. --;
Line 51, "by $R^{15}$ to $R^{16}$ and" should read -- by $R^{15}$ to $R^{18}$ and--.

Column 21,
Line 19, "$Ar^{13}$ to $Ar^{14}$," should read -- $Ar^{13}$ to $Ar^{16}$, --
Line 24, "the dial compound" should read -- the diol compound --.
Line 25, "the dial compound" should read -- the diol compound --;
Line 29, "same dial compounds" should read -- same diol compounds --.
Line 30, "the dial compound" should read -- the diol compound --.

Column 22,
Line 11, "$Ar^{17}$" to $Ar^{18}$." should read -- $Ar^{17}$ to $Ar^{19}$. --.

UNITED STATES PATENT AND TRADEMARK OFFICE

CERTIFICATE OF CORRECTION

PATENT NO. : 6,087,055
DATED : July 11, 2000
INVENTOR(S) : Tatsuya Niimi

It is certified that error appears in the above-identified patent and that said Letters Patent is hereby corrected as shown below:

Column 22,
Lines 21-37,

"

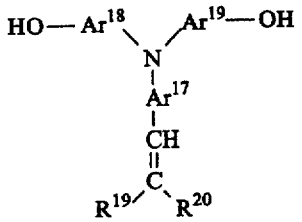

(9')

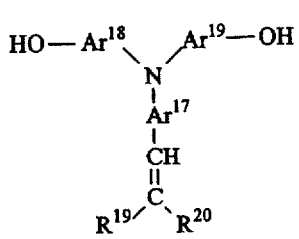

"

Should read

--

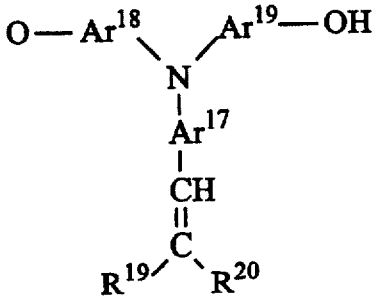

(9')

--.

UNITED STATES PATENT AND TRADEMARK OFFICE

CERTIFICATE OF CORRECTION

PATENT NO. : 6,087,055
DATED : July 11, 2000
INVENTOR(S) : Tatsuya Niimi

It is certified that error appears in the above-identified patent and that said Letters Patent is hereby corrected as shown below:

Column 24,
Line 10, "by $Ar^{24}$ to $Ar^{20}$," should read -- by $Ar^{24}$ to $Ar^{28}$, --,
Line 47, "$Ar^{24}$ to $Ar^{29}$," should read -- $Ar^{24}$ to $Ar^{28}$, --.

Column 25,
Line 27, "$Ar^{29}$ to $Ar^{32}$." should read -- $Ar^{29}$ to $Ar^{31}$. --.

Column 40,
Line 12, "Example 9 was" should read -- Example 8 was --.

Column 50,
Line 67, "therein said charge" should read -- wherein said charge -- .

Signed and Sealed this

Eighteenth Day of September, 2001

*Attest:*

Nicholas P. Godici

*Attesting Officer*

NICHOLAS P. GODICI
*Acting Director of the United States Patent and Trademark Office*